US008092964B2

(12) United States Patent
Hayashi et al.

(10) Patent No.: US 8,092,964 B2
(45) Date of Patent: Jan. 10, 2012

(54) TONER

(75) Inventors: Kenji Hayashi, Hachioji (JP); Mikio Kouyama, Kunitachi (JP); Tomoko Sakimura, Hino (JP); Hiroyuki Yasukawa, Hachioji (JP); Hiroaki Obata, Hino (JP); Natsuko Kusaka, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 746 days.

(21) Appl. No.: 12/194,451

(22) Filed: Aug. 19, 2008

(65) Prior Publication Data

US 2009/0075192 A1 Mar. 19, 2009

(30) Foreign Application Priority Data

Sep. 19, 2007 (JP) ..... 2007-242103

(51) Int. Cl.
*G03G 9/09* (2006.01)
*G03G 13/08* (2006.01)

(52) U.S. Cl. ..... 430/108.21; 430/123.57

(58) Field of Classification Search ..... 430/108.21
See application file for complete search history.

(56) References Cited

U.S. PATENT DOCUMENTS

| | | | | |
|---|---|---|---|---|
| 3,094,536 | A * | 6/1963 | Kenney et al. | 540/128 |
| 4,311,775 | A * | 1/1982 | Regan | 430/37 |
| 2002/0142240 | A1 * | 10/2002 | Katagiri et al. | 430/108.21 |
| 2008/0171278 | A1 | 7/2008 | Yasukawa et al. | |
| 2009/0075190 | A1 * | 3/2009 | Lin et al. | 430/57.2 |

FOREIGN PATENT DOCUMENTS

| | | |
|---|---|---|
| JP | 05-239368 | 9/1993 |
| JP | 2005-157314 | 6/2005 |
| JP | 2006-063171 | 3/2006 |

* cited by examiner

*Primary Examiner* — Christopher Rodee
*Assistant Examiner* — Jonathan Jelsma
(74) *Attorney, Agent, or Firm* — Squire, Sanders & Dempsey (US) LLP

(57) ABSTRACT

Disclosed is a toner comprising a resin and a colorant, wherein the colorant comprises a compound represented by formula (I) and a compound represented by formula (II).

formula (I)
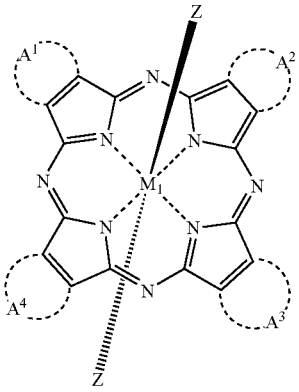
-continued
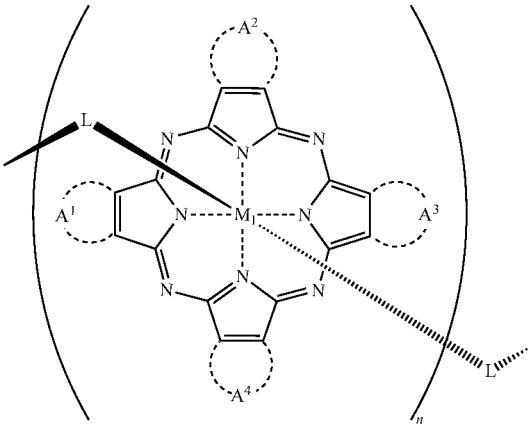
formula (II)
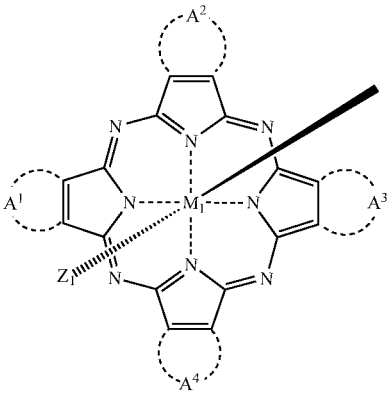
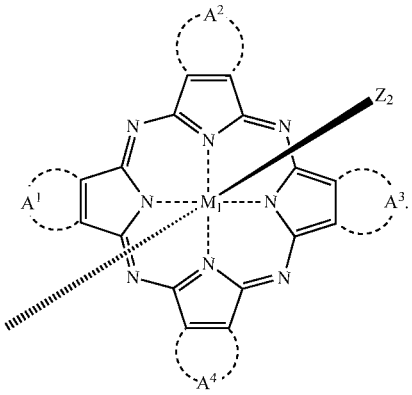
9 Claims, 3 Drawing Sheets

TONER

TECHNICAL FIELD

The present invention relates to electrostatic image developing toners for use in electrophotographic image formation and in particular to electrostatic image developing toners which contain phthalocyanine compounds as a colorant.

TECHNICAL BACKGROUND

Recently, electrophotographic image formation using electrostatic image developing toners (hereinafter, also denoted simply as toners) has been applicable to full-color prints as well as monochromatic prints as typified in conventional documentation. Such full-color image forming apparatuses, which can make printed sheets as required on demand without making printing plates, as in conventional printing, have been employed mainly for short-run printing in which orders for some hundreds sheets of print is often received, as described in, for example, JP-A 2005-157314 (hereinafter, the term JP-A refers to Japanese Patent Application Publication).

Thus, the field of performing image formation through an electrophotographic system, such as print making having been conducted in a printing factory, has rapidly expanded, while performance of stable print making is required for printers, even if image formation is conducted under some hard environment. For instance, a print making environment in a printing factory is said to be markedly severe, as compared to print making in the office. Further, there can be much anticipated cases of urgent print order and a high-performance toner which can display stable electrostatic-charging capability even under hard environments is desired in order to achieve print making of the required number of sheets within a limited time.

As described above, a toner which exhibits superior electrostatic-charging performance, that is, charge generating capability and charge holding capability even under hard environments of print making, for example, under a high temperature and high humidity condition or under low temperature and low humidity condition, can achieve stable print-making at beautiful-finished levels. Making prints for color catalogs or advertisements demands a toner capable of performing faithful color reproduction. In full-color image formation, mono-color toner images of yellow, magenta and cyan are superimposed to reproduce all color tones and techniques for enhancing color tones of these toners as bases become important points. Examples of such a technique for enhancement of toner color tone include a toner improvement technique by the use of a copper phthalocyanine compound, as described, for example, in JP-A 5-239368 and a toner designation technique for enhancement of color reproduction of photographic images such as color gravures, as described in, for example, JP-A 2006-63171.

Making prints by use of toners disclosed in the foregoing patent documents enabled to make prints of good color tones without color contamination under air-conditioned environments, such as business offices. However, prints which were made under high temperature and high humidity or low temperature and low humidity tended to cause difficulty in obtaining good color tone. It is thought that environmental influences renders it difficult to achieve stable electrostatic-charging and an insufficiently charged toner cannot achieve smooth transfer so that a given amount of a toner is not transferred, resulting in disruption of color balance of the toner image, adversely affecting print image quality. Thus, toner transfer of a given amount often becomes difficult under hard conditions for image formation such as high temperature and high humidity, or low temperature and low humidity, rendering it difficult to maintain favorable color balance of a toner image. Environmental effects rendering it difficult to achieve stable charging is disadvantageous for print factories having many chances of making color prints under hard environments.

SUMMARY OF THE INVENTION

It is an object of the present invention to provide a toner which is capable of perform sufficient charging without being affected by the production environment, even when subjected to an environment such as high temperature and high humidity or low temperature and low humidity. Specifically, it is an object to provide a toner capable of making color prints exhibiting superior color tone, even after being allowed to stand over a long duration under hard environments such as high temperature and high humidity, or low temperature and low humidity.

One aspect of the invention is directed to an electrophotographic toner comprising a resin and a colorant, wherein the colorant comprises a compound represented by the formula (I) and a compound represented by the formula (II):

formula (I)

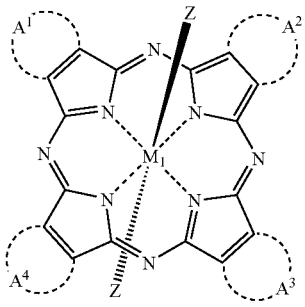

wherein $M_1$ is a metal atom selected from the group consisting of a silicon atom (Si), a germanium atom (Ge) and a tin atom (Sn); Z is a hydroxy group, a chlorine atom, an aryloxy group having 6 to 18 carbon atoms, an alkoxy group having 1 to 22 carbon atoms or a group represented by formula (III); and $A^1$, $A^2$, $A^3$ and $A^4$ are each independently an atomic group necessary to form a ring and selected from the group consisting of (1) to (29) which may have an electron-attractive substituent:

formula (II)

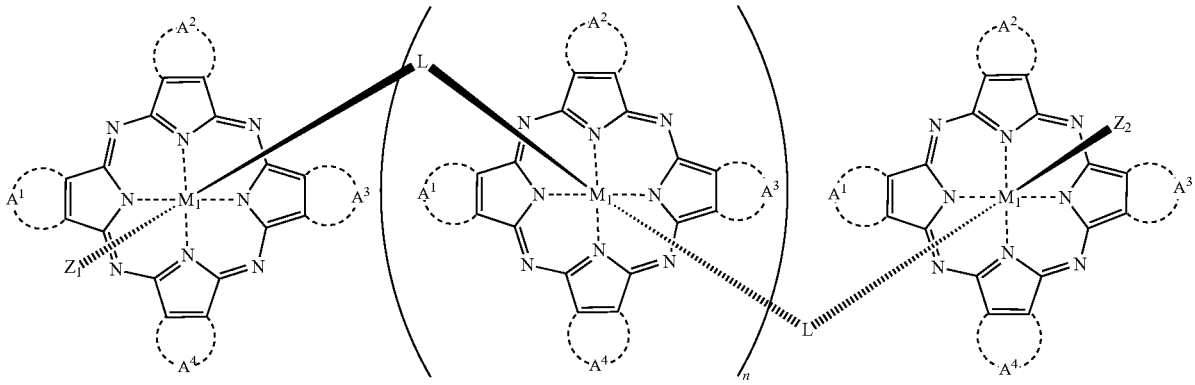

wherein n is 0 or an integer of 1 or more; $M_1$ is a metal atom selected from the group consisting of a silicon atom (Si), a germanium atom (Ge) and a tin atom (Sn); $Z_1$ and $Z_2$ are each independently a hydroxy group, a chlorine atom, an aryloxy group having 6 to 18 carbon atoms, an alkoxy group having 1 to 22 carbon atoms or a group of a structure represented by formula (III); Ls are each an oxygen atom or —O—Si(R)$_2$—O— in which R is an alkyl group having 1 to 4 carbon atoms, a chlorine atom or a hydroxy group; $A^1$, $A^2$, $A^3$ and $A^4$ are each independently an atomic group necessary to form a ring and selected from the group consisting of (1) to (29) which may have an electron-attractive substituent;

formula (III)

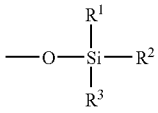

wherein $R^1$, $R^2$ and $R^3$ are each an alkyl group having 1 to 22 carbon atoms, an aryl group having 6 to 18 carbon atoms, an alkoxy group having 1 to 22 carbon atoms or an aryloxy group having 6 to 18 carbon atoms, provided that $R^1$, $R^2$ and $R^3$ may be the same or different;

(1)

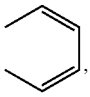

(2)

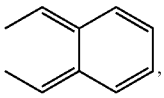

(3)

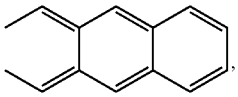

(4)

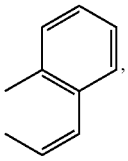

-continued (5)

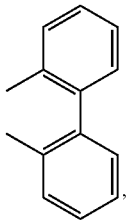

(6)

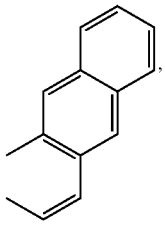

(7)

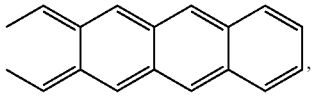

(8)

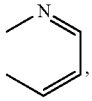

(9)

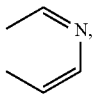

(10)

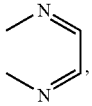

(11)

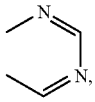

(12)

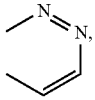

-continued (13)

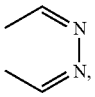

(14)

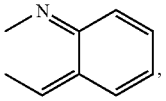

(15)

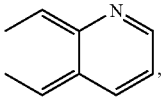

(16)

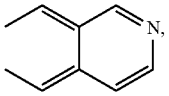

(17)

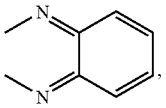

(18)

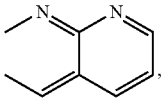

(19)

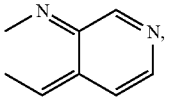

(20)

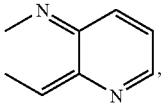

(21)

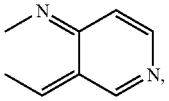

(22)

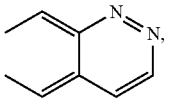

(23)

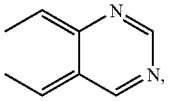

(24)

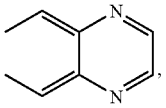

(25)

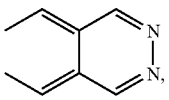

(26)

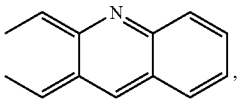

-continued (27)

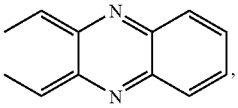

(28)

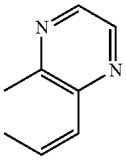

(29)

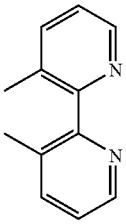

In the invention, the use of a toner containing a compound having one phthalocyanine ring and a compound having at least two phthalocyanine rings has enabled to provide color prints exhibiting prescribed color tone even under conditions of high temperature and high humidity or low temperature and low humidity. Thus, the toner relating to the invention enables to stably make prints of excellent color tone, even after aged over a long period of time under environments of high temperature and high humidity or low temperature and low humidity.

Accordingly, it has become possible to make prints of excellent color even in printing factories in which image formation environment is much severe, compared to ordinary business offices. In printing factories, color gravure photographs which were prepared through plate-making have become possible to be prepared without the extra effort for the plate-making, rendering it feasible to provide prints having a color photograph of excellent color.

The toner relating to the invention contains a so-called monomeric phthalocyanine compound having a single phthalocyanine ring and a so-called multimeric phthalocyanine compound having two or more phthalocyanine rings.

In the invention, a monomeric compound of a single phthalocyanine ring and a multimeric compound of plural phthalocyanine rings are included in the toner, whereby stable electric-charging performance has become possible to come into effect even under high temperature and high humidity or low temperature and low humidity. Further, electric-charging property and transferability have been enhanced, rendering it feasible to perform image formation. The reason for the toner of the invention having achieved stable charging performance without being adversely affected by image forming environments is presumed to be due to the three factors of charge-generation capability, charge-holding capability and electric resistance have come into effect in a balanced manner.

The state in which three factors of charge-generation capability, charge-holding capability and electric resistance have come into effect in a balanced manner is assumed to be realized by the arrangement of phthalocyanine compounds contained in toner particles. Thus, it is assumed that the phthalocyanine compounds are arranged in a state which renders it easy to accumulate an electric charge, such as a condenser. Namely, a cross-linkage structure of phthalocyanine rings is formed by the action of metal atoms and substituents forming the phthalocyanine compound, resulting in regular arrangement of phthalocyanine rings. It is assumed that phthalocyanine rings arranged in parallel in a toner particle, just like records being orderly housed in a jukebox and electric charge is accumulated between phthalocyanine rings arranged in parallel, which acts just like a condenser.

Such a structure as phthalocyanine rings being orderly arranged causes a tendency of making uniform resistance values of toner particles, which is assumed to be due that charges accumulated between arrangement structures of phthalocyanine rings are transferred similarly in the respective toner particles. Thus, it is considered that orderly arrangement of phthalocyanine rings controls the electrostatic capacity and the resistance value of the toner in a balanced manner, whereby charge accumulation is performed for a short time and accumulated charge is efficiently moved to the exterior of the toner particle, leading to development of stable charging performance. It is further considered that the presence of a multimeric substance having two or more phthalocyanine rings within the toner particle makes it easy to be regularly arranged, promoting stabilization of charging performance.

The present invention was also the novel discovery that a phthalocyanine compound performed charge generation by the action of friction during toner charging. Namely, although it was known that phthalocyanine compounds achieved charge generation upon exposure to light when used as a photoreceptor, such charge generation was also feasible by the action of friction, which was entirely distinct from light exposure.

DETAILED DESCRIPTION OF THE INVENTION

Figure 1:
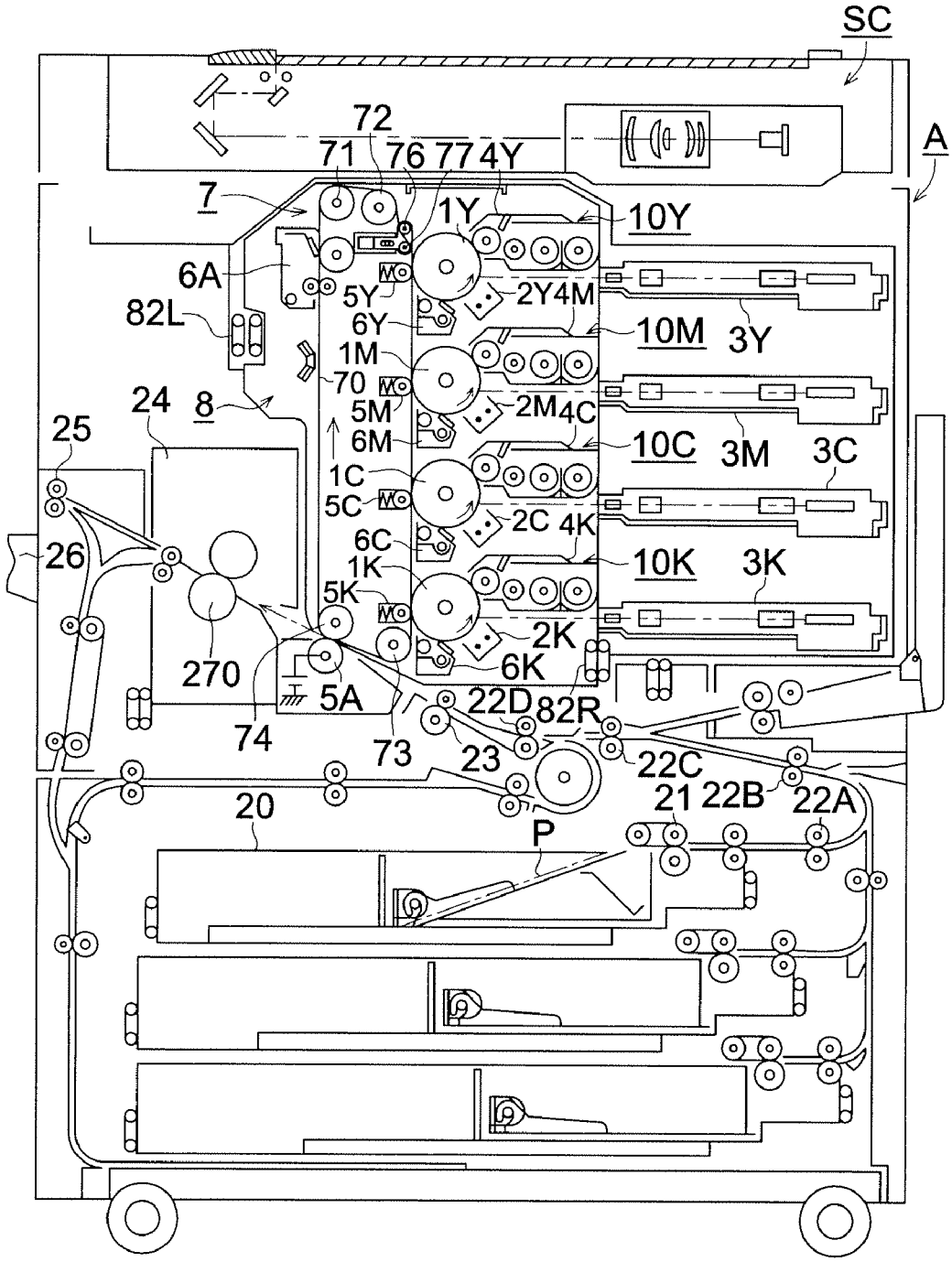
FIG. 1 illustrates an example of a tandem type full-color image forming apparatus in which image formation of a two-component development system is feasible.

The present invention will be further described in detail.

A toner relating to the invention comprises a binding resin and a colorant, and the coolant comprises a compound represented by the formula (I) and a multimeric compound represented by the formula (II):

Formula (I)

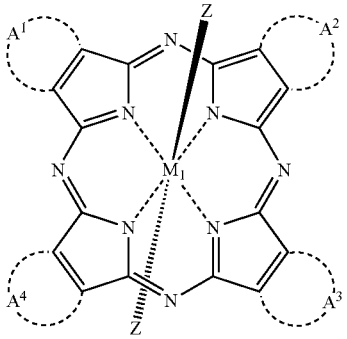

formula (II)

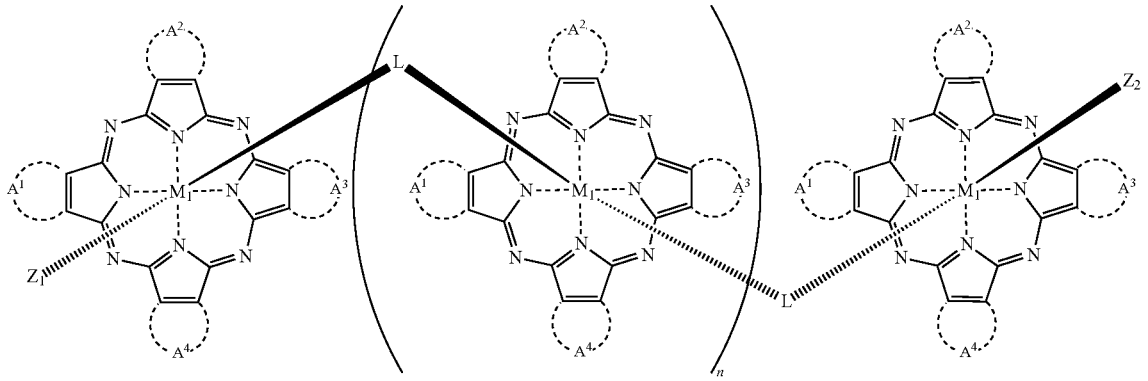

In the formulas (I) and (II), $M_1$ is a metal atom which is called a central metal atom and coordinates to a phthalocyanine ring, and any one of a silicon atom (Si), a germanium atom (Ge) and a tin atom (Sn) coordinates to a phthalocyanine ring. The compound of the formula (II) contains at least two phthalocyanine rings, in which n is 0 or an integer of 1 or more.

In the formulas (I) and (II), Z, $Z_1$ and $Z_2$, which are also called ligands, are each independently an aryloxy group having 6 to 18 carbon atoms, an alkoxy group having 1 to 22 carbon atoms or a group of a structure represented by the following formula (III); $L_1$ and $L_2$, which also correspond to ligands, represent an oxygen atom or —O—$SiR_2$—O— in which R is an alkyl group having 1 to 4 carbon atoms, a chlorine atom or a hydroxy group.

formula (III)
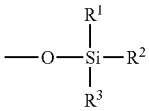
Further, $A^1$, $A^2$, $A^3$ and $A^4$ are each independently an atomic group necessary to form a ring, as represented below, which may be substituted by an electron-withdrawing group:
(1)
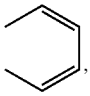
(2)
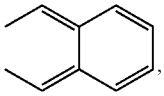
(3)
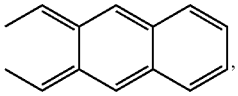
(4)
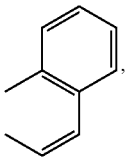
(5)
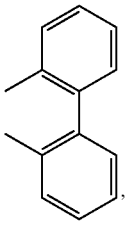
(6)
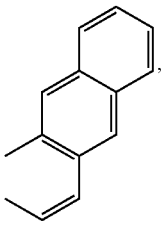
(7)
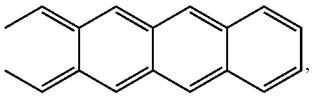
(8)
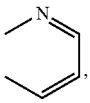
(9)
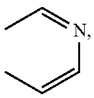
-continued
(10)
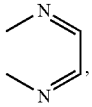
(11)
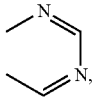
(12)
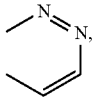
(13)
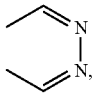
(14)
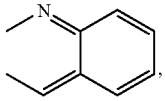
(15)
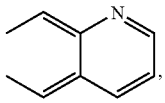
(16)
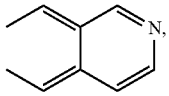
(17)
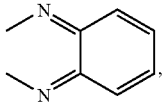
(18)
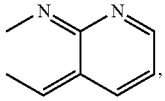
(19)
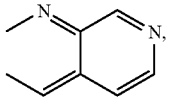
(20)
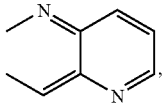
(21)
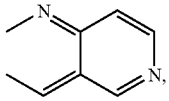
(22)
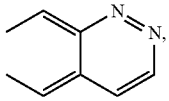
(23)
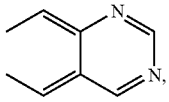

-continued (24)

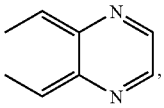

(25)

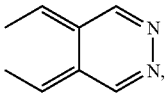

(26)

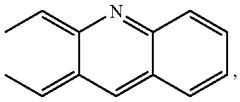

(27)

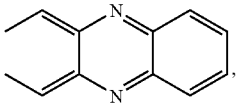

(28)

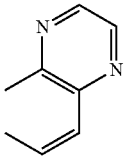

(29)

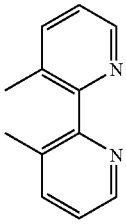

Compounds represented by the formulas (I) and (II) have a structure in which a metal atom, called a central metal atom and represented by $M_1$, is bound to groups (also called ligands) represented by Z ($Z_1$, $Z_2$) and L.

The central metal atom $M_1$ constituting the compounds of formulas (I) and (II) is a silicon atom (Si), germanium atom (Ge) or tin atom (Sn), and the use of a silicon atom (Si) is preferred in the invention.

In the formulas (I) and (II), a substituent represented by Z, or $Z_1$ or $Z_2$ is preferably a group of formula (III). In the formula (III), $R^1$, $R^2$ and $R^3$ are each preferably an alkyl group having 1 to 6 carbon atoms, an aryl group or an alkoxy group, and more preferably a methyl group, ethyl group, n-propyl group, isopropyl group, n-butyl group, isobutyl group, and t-butyl group. $R^1$, $R^2$ and $R^3$ may be the same or different. The group represented by L is preferably an oxygen atom.

In the formulas (I) and (II), $A^1$, $A^2$, $A^3$ and $A^4$ are each include atomic groups afore-described, and the ring formed of $A^1$, $A^2$, $A^3$ or $A^4$ is preferably an aromatic ring, more preferably a benzene or naphthalene ring and still more preferably a benzene ring. Further, examples of an electron withdrawing group (or substituent) which may be attached to the foregoing atomic group include a chlorine group (—Cl), a halogenated methyl group (—$CClX_2$), a trifluoromethyl group (—$CF_3$), a nitro group (—$NO_2$) and a sulfonic acid group (—$SO_3H$).

Specific examples of the compound represented by the formula (I) are shown in Table 1, but the compound of the formula (I) and usable in the invention are not limited to the compounds shown in Tables 1-3.

TABLE 1

| Compound No. | Atomic Group ($A^1$, $A^2$, $A^3$, $A^4$) | Metal Atom ($M_1$) | Z | Substituent on Atomic Group |
|---|---|---|---|---|
| I-1 | (1) | silicon (Si) | —O—$Si(CH_2CH_3)_3$ | |
| I-2 | (1) | silicon (Si) | —OH | |
| I-3 | (1) | silicon (Si) | —O—$Si(CH_2CH_2CH_3)_3$ | |
| I-4 | (1) | silicon (Si) | —O—$Si(CH_3)_3$ | |
| I-5 | (1) | silicon (Si) | —O—$Si(CH(CH_3)_2)_3$ | |
| I-6 | (1) | silicon (Si) | —Cl | |
| I-7 | (1) | silicon (Si) | —O—$Si(CH_2CH_2CH_2CH_2CH_2CH_2CH_2CH_3)(CH_3)_2$ | |
| I-8 | (1) | silicon (Si) | —O—$Si(t\text{-}C_4H_9)_3$ | |
| I-9 | (1) | silicon (Si) | —O—$Si(CH_2CH_3)_3$ | 3-chloro group |
| I-10 | (1) | silicon (Si) | —O—$Si(CH_2CH_3)_3$ | 3,4-dichloro group |
| I-11 | (1) | silicon (Si) | —O—$Si(CH_2CH_3)_3$ | 3-trifluoromethyl group |
| I-12 | (1) | silicon (Si) | —O—$Si(C_{11}H_{23})(CH_3)_2$ | |
| I-13 | (1) | silicon (Si) | —O—$Si(C_{22}H_{45})(CH_2CH_3)(CH_3)$ | |
| I-14 | (1) | silicon (Si) | —O—$Si(CH_2CH_3)(CH_3)(C_6H_5)$ | |
| I-15 | (1) | silicon (Si) | —O—$Si(CH_2CH_3)(CH_3)(C_{18}H_{11})$ | |
| I-16 | (1) | silicon (Si) | —O—$Si(OCH_3)(OC_{22}H_{45})CH_3$ | |

TABLE 2

| Compound No. | Atomic Group ($A^1$, $A^2$, $A^3$, $A^4$) | Metal Atom ($M_1$) | Z | Substituent on Atomic Group |
|---|---|---|---|---|
| I-17 | (1) | silicon (Si) | —O—$Si(OC_2H_5)_2(OC_10H_{21})$ | |
| I-18 | (1) | silicon (Si) | —O—$CH_3$ | |
| I-19 | (1) | silicon (Si) | —O—$CH_2CH_3$ | |
| I-20 | (1) | silicon (Si) | —O—$CH_2(CH_2)_6CH_3$ | |

TABLE 2-continued

| Compound No. | Atomic Group ($A^1$, $A^2$, $A^3$, $A^4$) | Metal Atom ($M_1$) | Z | Substituent on Atomic Group |
|---|---|---|---|---|
| I-21 | (1) | silicon (Si) | —O—$C_{11}H_{23}$ | |
| I-22 | (1) | silicon (Si) | —O—$C_{22}H_{45}$ | |
| I-23 | (1) | silicon (Si) | —O—$C_6H_5$(1-phenoxy) | |
| I-24 | (1) | silicon (Si) | —O—$C_{10}H_7$(1-naphthoxy) | |
| I-25 | (1) | silicon (Si) | —O—$C_{14}H_9$(1-anthranyloxy) | |
| I-26 | (1) | silicon (Si) | —O—$C_{16}H_9$(1-pyrenyloxy) | |
| I-27 | (1) | silicon (Si) | —O—$C_{18}H_{11}$(1-tetracenyloxy) | |
| I-28 | (1) | silicon (Si) | —O—$Si(OC_6H_5)(OCH_3)(CH_3)$ | |
| I-29 | (1) | silicon (Si) | —O—$Si(OC_{18}H_{11})(OCH_3)(CH_3)$ | |
| I-30 | (1) | silicon (Si) | —O—$Si(CH_2CH_2CH_2CH_3)(CH_3)_2$ | |
| I-31 | (1) | silicon (Si) | —O—$Si(CH_2CH(CH_3)_2)(CH_3)_2$ | |
| I-32 | (2) | silicon (Si) | —OH | |

TABLE 3

| Compound No. | Atomic Group ($A^1$, $A^2$, $A^3$, $A^4$) | Metal Atom ($M_1$) | Z | Substituent on Atomic Group |
|---|---|---|---|---|
| I-33 | (2) | silicon (Si) | —Cl | |
| I-34 | (2) | silicon (Si) | —O—$Si(CH_2CH_3)_3$ | |
| I-35 | (2) | silicon (Si) | —O—$CH_2CH_3$ | |
| I-36 | (2) | silicon (Si) | —O—$C_6H_5$(1-phenoxy) | |
| I-37 | (1) | germanium (Ge) | —OH | |
| I-38 | (1) | germanium (Ge) | —O—$Si(CH_2CH_2CH_3)_3$ | |
| I-39 | (1) | germanium (Ge) | —O—$CH_2CH_3$ | |
| I-40 | (1) | germanium (Ge) | —O—$C_6H_5$(1-phenoxy) | |
| I-41 | (1) | tin (Sn) | —OH | |
| I-42 | (1) | tin (Sn) | —O—$Si(CH_2CH_2CH_3)_3$ | |
| I-43 | (1) | tin (Sn) | —O—$CH_2CH_3$ | |
| I-44 | (1) | tin (Sn) | —O—$C_6H_5$(1-phenoxy) | |
| I-45 | (1) | germanium (Ge) | —Cl | |
| I-46 | (1) | tin (Sn) | —Cl | |
| I-47 | (1) | tin (Sn) | —O—$C_{10}H_7$(1-naphthoxy) | |
| I-48 | (2) | germanium (Ge) | —O—$Si(CH_2CH_3)_3$ | |
| I-49 | (2) | tin (Sn) | —O—$Si(CH_2CH_3)_3$ | |
| I-50 | (2) | tin (Sn) | —OH | |

Specific examples of the compound represented by the formula (II) are shown below but compounds of the formula (II) and usable invention are not limited to these. First, specific examples of a dimeric compound represented by the following formula are shown in Tables 4-6. The dimeric compound corresponds to the case of the value of n being zero in the foregoing formula (II).

formula [II (dimer)]

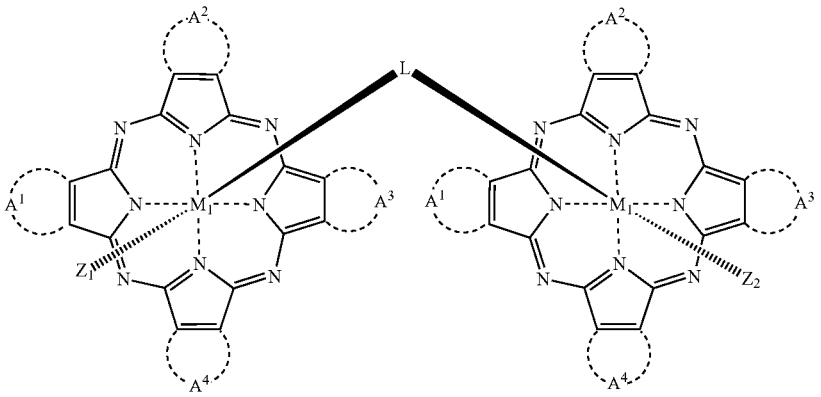

TABLE 4

| Compound No. | Atomic Group ($A^1, A^2, A^3, A^4$) | Metal Atom ($M_1$) | $Z_1, Z_2$ | L |
|---|---|---|---|---|
| II-1 | (1) | silicon (Si) | —O—$Si(CH_2CH_2CH_3)_3$ | —O—$Si(CH_3)_2$—O— |
| II-2 | (1) | silicon (Si) | —O—$Si(CH_2CH_2CH_3)_3$ | —O— |
| II-3 | (1) | silicon (Si) | —O—$Si(t\text{-}C_4H_9)_3$ | —O— |
| II-4 | (1) | silicon (Si) | —O—$Si(CH(CH_3)_2)_3$ | —O— |
| II-5 | (1) | silicon (Si) | —O—$Si(CH_2CH_2CH_3)_3$ | —O—$Si(CH_2CH_3)_2$—O— |
| II-6 | (1) | silicon (Si) | —O—$Si(t\text{-}C_4H_9)_3$ | —O—$Si(OH)_2$—O— |
| II-7 | (1) | silicon (Si) | —O—$Si(CH(CH_3)_2)_3$ | —O—$Si(t\text{-}C_4H_9)_2$—O— |
| II-8 | (1) | silicon (Si) | —O—$Si(CH_2CH_2CH_3)_3$ | —O—$Si(CH_3)(CH_2CH_3)$—O— |
| II-9 | (1) | silicon (Si) | —O—$Si(CH_{22}H_{45})(CH_3)_2$ | —O—$Si(CH_3)_2$—O— |
| II-10 | (1) | silicon (Si) | —O—$Si(C_6H_5)(CH_2CH_3)_2$ | —O— |
| II-11 | (1) | silicon (Si) | —O—$Si(C_{18}H_{11})(CH_3)_2$ | —O—$Si(CH_2CH_3)_2$—O— |
| II-12 | (1) | silicon (Si) | —O—$Si(OCH_3)_3$ | —O—$Si(CH_3)_2$—O— |
| II-13 | (1) | silicon (Si) | —O—$Si(OC_6H_5)(CH_3)_2$ | —O— |
| II-14 | (1) | silicon (Si) | —O—$Si(OC_{22}H_{45})(CH_3)_2$ | —O—$Si(CH_3)_2$—O— |

TABLE 5

| Compound No. | Atomic Group ($A^1, A^2, A^3, A^4$) | Metal Atom ($M_1$) | $Z_1, Z_2$ | L |
|---|---|---|---|---|
| II-15 | (1) | silicon (Si) | —O—$Si(OC_{18}H_{11})(CH_3)_2$ | —O— |
| II-16 | (1) | silicon (Si) | —O—$C_6H_5$ | —O— |
| II-17 | (1) | silicon (Si) | —O—$C_{10}H_7$(1-naphthoxy) | —O— |
| II-18 | (1) | silicon (Si) | —O—$C_{18}H_{11}$(1-tetracenyloxy) | —O—$Si(CH_3)_2$—O— |
| II-19 | (1) | silicon (Si) | —O—$CH_3$ | —O— |
| II-20 | (1) | silicon (Si) | —O—$C_{11}H_{23}$ | —O—$Si(CH_2CH_3)_2$—O— |
| II-21 | (1) | silicon (Si) | —O—$C_{22}H_{45}$ | —O— |
| II-22 | (1) | silicon (Si) | —O—$Si(C_{22}H_{45})(CH_3)_2$ | —O— |
| II-23 | (1) | silicon (Si) | —O—$Si(CH_3)_3$ | —O—$Si(CH_3)(CH_2CH_2CH_3)$—O— |
| II-24 | (1) | silicon (Si) | —O—$Si(CH_2CH_3)_2CH_3$ | —O— |
| II-25 | (1) | silicon (Si) | —OH | —O— |
| II-26 | (1) | silicon (Si) | —Cl | —O—$Si(CH_2CH_3)_2$—O— |
| II-27 | (1) | silicon (Si) | —O—$Si(CH_3)_3$, —O—$Si(CH_2CH_3)_3$ | —O— |
| II-28 | (1) | silicon (Si) | —OH, —O—$CH_2CH_3$ | —O—$Si(CH_3)_2$—O— |

TABLE 6

| Compound No. | Atomic Group ($A^1, A^2, A^3, A^4$) | Metal Atom ($M_1$) | $Z_1, Z_2$ | L |
|---|---|---|---|---|
| II-29 | (1) | silicon (Si) | —OH, —O—$C_6H_5$ | —O—$Si(CH_3)_2$—O— |
| II-30 | (1) | silicon (Si) | —O—$Si(CH_2CH_2CH_2CH_3)_2(CH_3)$ | —O— |
| II-31 | (2) | silicon (Si) | —OH | —O— |
| II-32 | (2) | silicon (Si) | —Cl | —O— |
| II-33 | (2) | silicon (Si) | —O—$Si(CH_2CH_3)_3$ | —O—$Si(CH_2CH_3)_2$—O— |
| II-34 | (2) | silicon (Si) | —O—$CH_3$ | —O— |
| II-35 | (1) | germanium (Ge) | —O—$CH_2CH_3$ | —O— |
| II-36 | (1) | germanium (Ge) | —OH | —O— |
| II-37 | (1) | germanium (Ge) | —O—$Si(CH_2CH_3)(CH_3)_2$ | —O—$Si(CH_2CH_3)_2$—O— |
| II-38 | (1) | tin (Sn) | —O—$C_6H_5$ | —O— |
| II-39 | (1) | tin (Sn) | —Cl | —O—$Si(CH_3)_2$—O— |
| II-40 | (1) | tin (Sn) | —O—$Si(CH_3)(CH_2CH_2CH_3)_2$ | —O— |
| II-41 | (2) | tin (Sn) | —OH | —O— |
| II-42 | (2) | germanium (Ge) | —O—$C_6H_5$ | —O— |

Specific examples of trimeric compounds are shown below but are not limited to these.

(II-51)
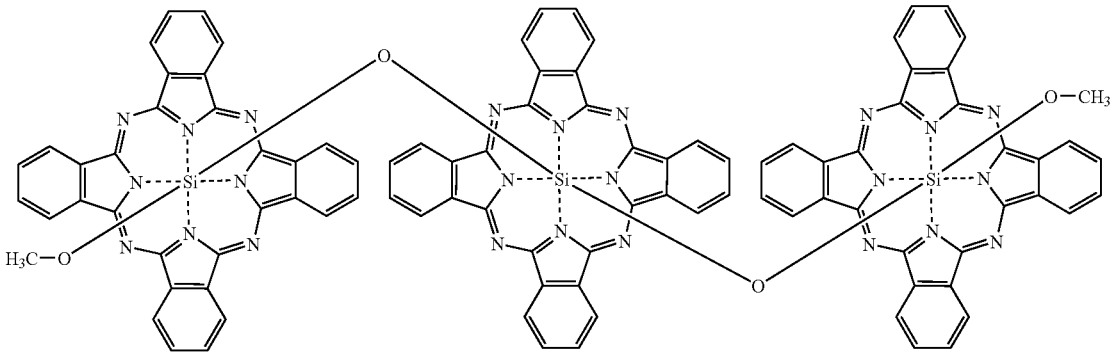
(II-52)
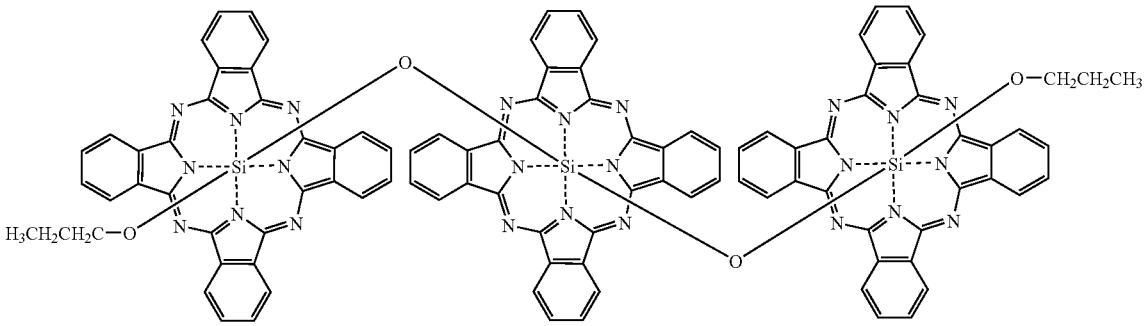
(II-53)
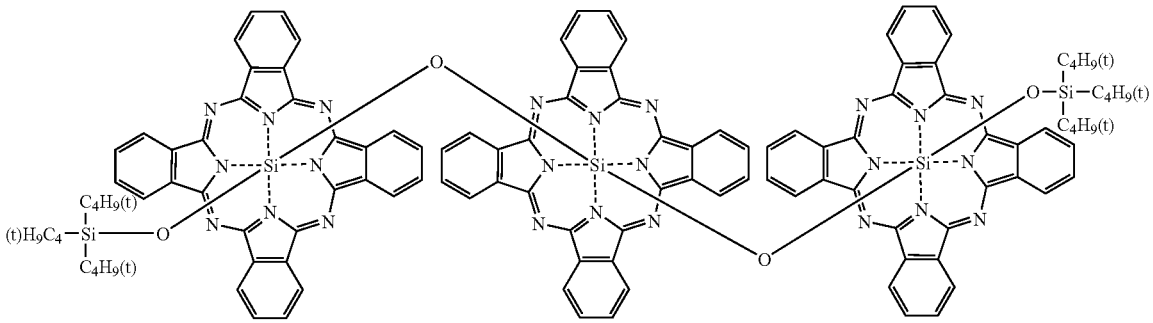
(II-54)
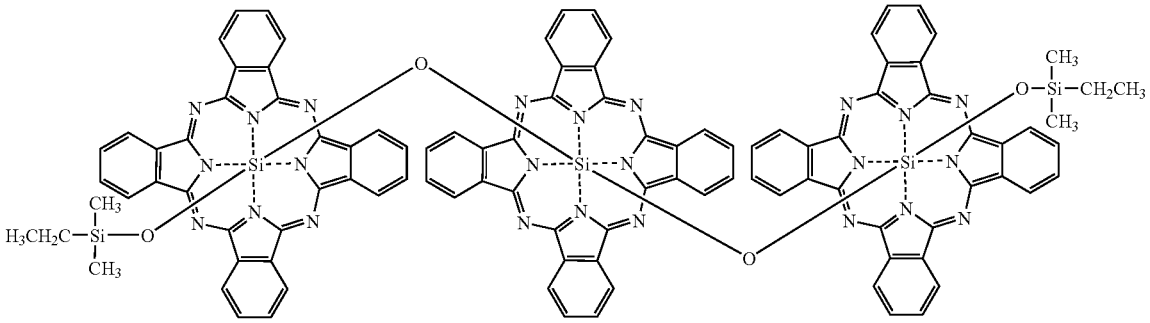

-continued (II-55)

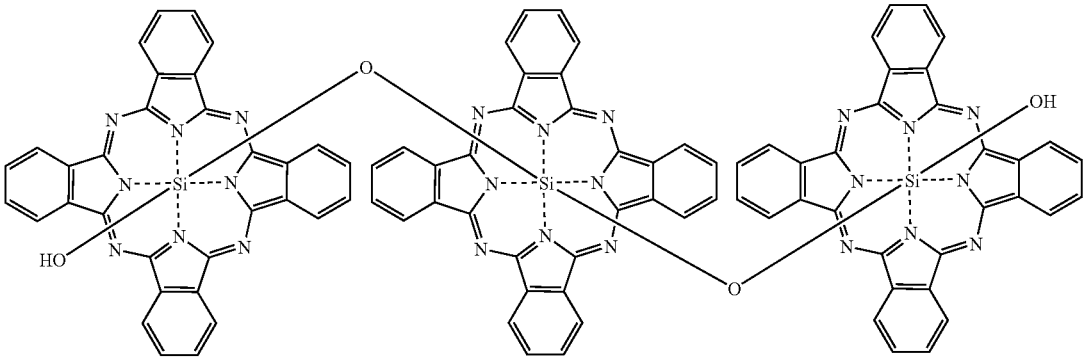

(II-56)

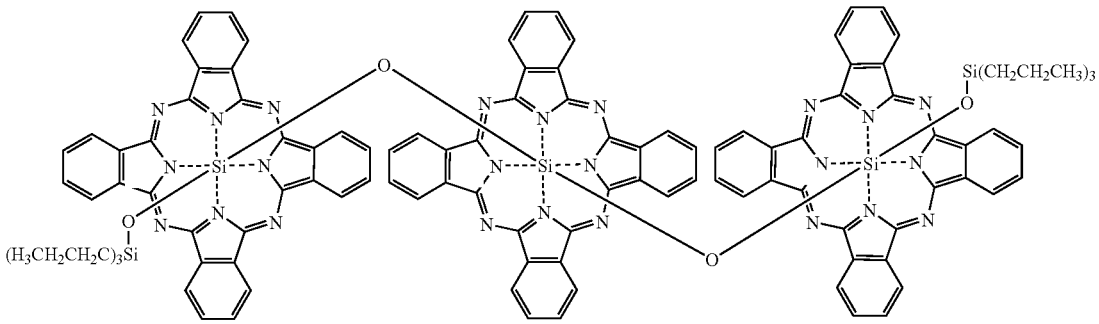

(II-57)

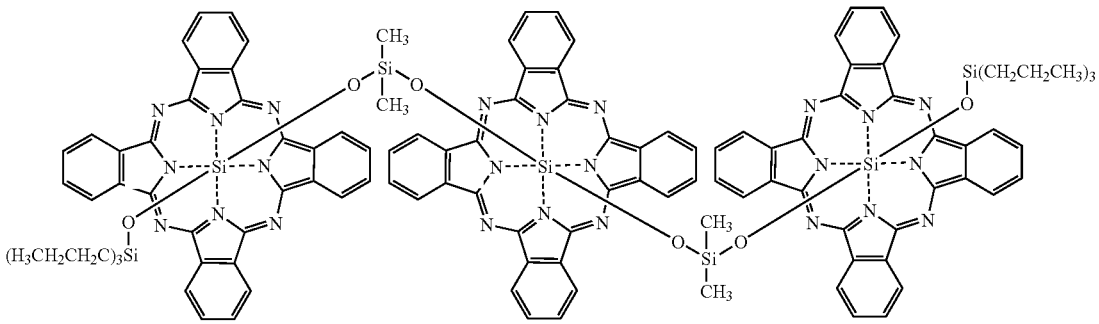

In the toner relating to the invention, the ratio by mass of compound of formula (I): compound of formula (II) is preferably within the range of 85:15 to 50:50, whereby more advantageous effects of the invention are achieved. It is assumed that when the mass ratio of compound of formula (I) to that of formula (II) falls within the foregoing range, parallel arrangement of phthalocyanine rings is naturally formed during toner production, making orientation of phthalocyanine rings easier.

When the ratio by mass of compound of formula (I): compound of formula (II) is within the range of 85:15 to 50:50, advantageous effects of the invention have been achieved but the ratio of formula (I): formula (II) is more preferably within the range of from 75:25 to 60:40.

Compounds of formula (I) and those of formula (II) can be prepared according to known methods disclosed in the following literatures. First, preparation methods of tetrazaporphin compounds represented by formula (I) (which are phthalocyanine compounds having ligands) can be referred to the following patent documents: U.S. Pat. Nos. 5,428,152, 4,927,735, 5,021,563, 5,219,706, 5,034,309, 5,284,943, 5,075,203, 5,484,685, 5,039,600, 5,438,135 and 5,665,875.

Preparation methods of multimeric compounds represented by the formula (II) include, for example, a preparation method using a dichlorosilicon phthalocyanine compound, as disclosed in JP-A 10-158534. For instance, the foregoing patent document discloses preparation of a dimerized dihydroxysilicon phthalocyanine compound as one of the compounds of formula (II), which was published in E. Ciliberto et al., J. Am. Chem. Soc. (1984). First, 1,3-diiminoisoindoline or phthalodinitrile and silicon tetrachloride are heated in a solvent and the reaction product is filtered, washed and purified to form dichlorosilicon phthalocyanine. This compound is subjected to an alkali treatment to obtain a dihydroxysilicon phthalocyanine compound, which is heated in a high-boiling solvent such as quinoline and further subjected to an alkali treatment to obtain a dimerized dihydroxysilicone phthalocyanine compound. Alternatively, dichlorosilicon phthalocyanine compound is heated in a hydrophilic polar solvent such as N-methylpyrrolidone, N,N-dimethylformamide, N,N-dimethylacetoamide, dimethylsulfoxide or sulfolane and further subjected to an alkali treatment.

In the invention, the colorant content is preferably from 1 to 30% by mass of the total of a toner, and more preferably from 2 to 20% by mass.

There will be further described particle size of the toner of the invention.

Toner particles relating to the invention preferably exhibit a volume-based median diameter (also denoted simply as D50v) of not less than 3 μm and not more than 8 μm. The volume-based median diameter falling within the foregoing region enables faithful reproduction of fine-dot images, for example, at a level of 1200 dpi (dpi: the number of dots per inch or 2.54 cm).

The minute particle size level at a volume-based median diameter falling within the minute particle size enables to obtain a highly precise photographic image in which a dot image constituting the photographic image is equivalent to or more than a high-precision printed image. Specifically, in on-demand printing in which orders for several hundreds to several thousands sets are often received, high image quality prints with high-precision photographic images can be delivered to a user.

The volume-based median diameter (D50v) of toner particles can be determined using COULTER MULTISIZER 3 (Beckmann Coulter Co.), connected to a computer system for data processing.

The measurement procedure is as follows: 0.02 g of toner particles are added to 20 ml of a surfactant solution (for example, a surfactant solution obtained by diluting a surfactant containing neutral detergent with pure water to a factor of 10) and dispersed by an ultrasonic homogenizer to prepare a toner dispersion. Using a pipette, the toner dispersion is poured into a beaker having ISOTON II (produced by Beckman Coulter Co.) within a sample stand, until reaching a measurement concentration of 5 to 10%. The measurement count was set to 2,500 to perform measurement. Then aperture diameter of MULTISIZER 3 was 50 μm.

The toner of the invention preferably exhibits a coefficient of variation (CV value) of volume-based particle size distribution of not less than 2% and not more than 21%, more preferably not less than 5% and not more than 15%. The coefficient of variation (CV value) of volume-based particle size distribution represents a dispersion degree of particle size distribution, based on volume and defined as below:

CV value (%)={(standard deviation of volume-based particle size distribution)/[median diameter (D50v) of volume-based particle size distribution]}×100

A low value indicates a sharper particle size distribution and means that the particle size tends to be uniform. Uniform particle size enables more precise reproduction of fine-dot images or fine lines, as is essential in digital image formation. Printing a photographic image with uniform-sized toner particles results in photographic images of high image quality at a level equivalent to or higher than an image prepared by printing ink.

The toner of the invention preferably exhibits a softening point at a temperature of 70 to 110° C., and more preferably 70 to 100° C. Colorants used in the toner of the invention are stable, causing no change in spectrum even when affected by heat. A softening point falling with the foregoing range can reduce effects of heat applied to the toner in fixing. Accordingly, image formation is performed without relying on a colorant, so that it is expected to, develop broad stable-color reproduction.

A toner of a softening point falling within the foregoing range enables fixing a toner image at a lower temperature than the prior art, rendering it feasible to perform image formation friendly to environments at reduced power consumption.

The softening point of a toner can be controlled by the following methods, singly or in combination. Thus, (1) the kind or the composition of monomer used for resin formation is adjusted; (2) the molecular weight of a resin is controlled by the kind or the amount of a chain-transfer agent; (3) the kind or amount of a wax is controlled.

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a 1 mm long nozzle, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

There will be described a method of preparing the toner of the invention.

The toner of the invention is comprised of particles containing at least a resin and a colorant (hereinafter, also denoted as colored particles). The colored particles constituting the toner of the invention are not specifically limited but can be prepared according the convention methods for preparing toners. More specifically, preparation is feasible by applying, for example, a so-called grinding method for preparing a toner through kneading, grinding and classification or a preparation method of a polymer toner in which a polymerizable monomer is polymerized with controlling the shape or size of particles to achieve particle formation (for example, emulsion polymerization, suspension polymerization, or polyester elongation).

When preparing the toner of the invention through a grinding method, kneading is performed with maintaining a temperature at not more than 130° C. When kneading a mixture at a temperature exceeding 130° C., heating action applied to the mixture tends to cause variation in the coagulation state of a colorant, rendering it difficult to maintain uniform colorant coagulation. It is a concern that variation in the coagulation state causes variations in color of the prepared toner, leading to color contamination.

Next, there will be described resin and wax constituting the toner of the invention, with reference to examples.

Resins usable for the toner of the invention are not specifically limited but are typically polymers formed by polymerization of polymerizable monomers which are called vinyl monomers. A polymer constituting a resin usable in the invention is constituted of a polymer obtained by polymerization of at least one polymerizable monomer, which is a polymer prepared by using vinyl monomers singly or in combination.

Specific examples of a polymerizable vinyl monomer are below:

(1) Styrene or Styrene Derivatives:

styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;

(2) Methacrylic Acid Ester Derivatives:

methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylic Acid Ester Derivatives:

methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate;

(4) Olefins:

ethylene, propylene and isobutylene;

(5) Vinyl Esters:

vinyl propionate, vinyl acetate and vinyl benzoate;

(6) Vinyl Ethers:

vinyl methyl ether and vinyl ethyl ether;

(7) Vinyl Ketones:

vinyl methyl ketone, vinyl ethyl ketone and vinyl hexyl ketone;

(8) N-Vinyl Compounds:

N-vinyl carbazole, N-vinyl indole and N-vinyl pyrrolidone;

(9) Others:

vinyl compounds such as vinylnaphthalene and vinylpyridine; acrylic acid or methacrylic acid derivatives such as acrylonitrile, methacrylonitrile and acrylamide.

There may also usable polymerizable monomers containing ionic-dissociative group, as a vinyl monomer, including, for example, those having a side chain containing a functional group such as a carboxyl group, a sulfonic acid group or a phosphoric acid group.

Specific examples include carboxyl group containing monomers such as acrylic acid, methacrylic acid, maleic acid, itaconic acid, cinnamic acid, fumaric acid, monoalkyl maleate, monoalkyl itaconate; sulfonic acid group containing monomers such as styrenesulfonic acid, allylsulfosuccinic acid, 2-acrylamido-2-methylpropanesulfonic acid; and phosphoric acid group containing monomers such as acid phosphooxyethyl methacrylate.

Further, a cross-linked resin can be obtained using polyfunctional vinyls such as divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

Waxes usable in the toner of the invention are those known in the art. Examples thereof include (1) polyolefin wax such as polyethylene wax and polypropylene wax; (2) long chain hydrocarbon wax such as paraffin wax and sasol wax; (3) dialkylketone type wax such as distearylketone; (4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristearate, and distearyl meleate; and (5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

There may be incorporated, in the process of preparing the toner of the invention, inorganic organic microparticles having a number-average primary particle size of 4 to 800 nm as an external additive to prepare the toner.

Incorporation of an external additive results in improved fluidity or electrostatic property or achieves enhanced cleaning ability. The kind of external additives is not specifically limited and examples thereof include inorganic microparticles, organic microparticles and a sliding agent, as described below.

There are usable commonly known inorganic microparticles and preferred examples thereof include silica, titania, alumina and strontium titanate microparticles. There may optionally be used inorganic microparticles which have been subjected to a hydrophobilization treatment.

Specific examples of silica microparticles include R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania microparticles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which as commercially available from Fuji Titan Co., Ltd.; IT-S, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Co., Ltd.

Spherical organic microparticles having a number-average primary particle size of 10 to 2000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total toner. The external additive or lubricant can be incorporated by using commonly known mixing devices such as a turbuler mixer, a HENSCHEL MIXER, a Nauter mixer or a V-shape mixer.

The toner of the invention is usable as a two-component developer comprised of a carrier and a toner, or a single-component developer comprised of a toner alone.

The use of the toner of the invention as a two-component developer enables full-color printing by using a tandem system image forming apparatus, as described later. Further, appropriate selection of a resin and a wax constituting a toner enables full-color printing corresponding to low-temperature fixing in which a paper temperature is approximately 100° C. in fixing.

Magnetic particles used as a carrier of a two-component developer can use commonly known materials, e.g., metals such as iron, ferrite and magnetite and alloys of the foregoing metals and metals such as aluminum or lead. Of these, ferrite particles are preferred. The volume-average particle size of a carrier of a carrier is preferably from 15 to 100 μm. and more preferably from 25 to 80 μm.

When used as a nonmagnetic single-component developer without a carrier to perform image formation, a toner is charged with being rubbed or pressed onto a charging member or the developing roller surface. Image formation in a nonmagnetic single-component development system can simplify the structure of a developing device, leading to a merit of compactification of the whole image forming apparatus. Therefore, the use of the toner of the invention as a single-component developer can achieve full-color printing in a compact printer, making it feasible to prepare full-color prints of superior color reproduction even in a space-limited working environment.

There will be described image formation using the toner of the invention. First, there will be described image formation using the toner of the invention as a two-component developer.

FIG. 1 illustrates an example of an image forming apparatus in which the toner of the invention is usable as a two-component developer.

In FIG. 1, 1Y, 1M, 1C and 1K each designate photoreceptors; 4Y, 4M, 4C and 4K each designate a developing means; 5Y, 5M, 5C and 5K each designate primary transfer rollers as a primary transfer means; 5A designates a secondary transfer roller as a secondary transfer means; 6Y, 6M, 6C and 6K each designate cleaning means; the numeral 7 designates an intermediate transfer unit; the numeral 24 designates a thermal roll type fixing device; and the numeral 70 designates an intermediate transfer material.

This image forming apparatus is called a tandem color image forming apparatus, which is, as a main constitution, composed of plural image forming sections 10Y, 10M, 10C and 10B, an intermediate transfer material unit 7 as a transfer section including an endless belt form of a transfer belt, paper feeding and conveying means 22A to 22D to convey recording member P and heated roll-type fixing device 24 as a fixing means. Original image reading device SC is disposed in the upper section of image forming apparatus body A.

Image forming section 10Y to form a yellow image as one of different color toner images formed on the respective photoreceptors comprises drum-form photoreceptor 1Y as the first photoreceptor; electrostatic-charging means 2Y, exposure means 3Y and developing means 4Y which are disposed around the photoreceptor 1Y; primary transfer roller 5Y as a primary transfer means; and cleaning means 6Y.

Image forming section 10M to form a magenta image as one of different color toner images formed on the respective photoreceptors comprises drum-form photoreceptor 1M as the second photoreceptor; electrostatic-charging means 2M, exposure means 3M and developing means 4M which are disposed around the photoreceptor 1M; primary transfer roller 5M as a primary transfer means; and cleaning means 6M.

Image forming section 10C to form a cyan image as one of different color toner images formed on the respective photoreceptors comprises drum-form photoreceptor 1C as the third photoreceptor; electrostatic-charging means 2Y, exposure means 3C and developing means 4C which are disposed around the photoreceptor 1C; primary transfer roller 5C as a primary transfer means; and cleaning means 6C.

Image forming section 10K to form a black image as one of different color toner images formed on the respective photoreceptors comprises drum-form photoreceptor 1K as the fourth photoreceptor; electrostatic-charging means 2K, exposure means 3K and developing means 4K which are disposed around the photoreceptor 1K; primary transfer roller 5K as a primary transfer means; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

Housing 8, which can be pulled out from the apparatus body (A) through supporting rails 82L and 82R, is comprised of image forming sections 10Y, 10M, 10C and 10K and the intermediate transfer unit (7) of an endless belt form.

Figure 2:
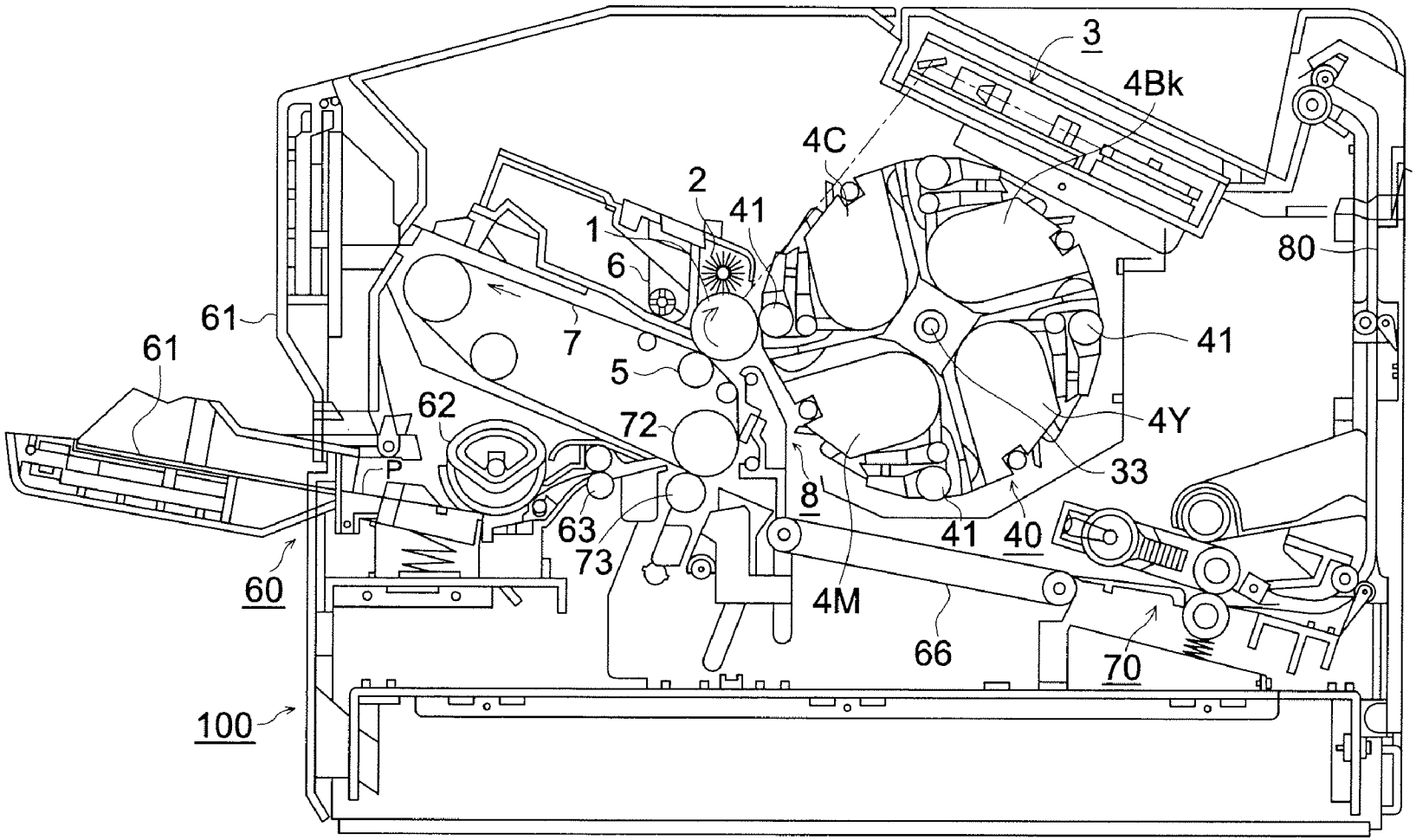
FIG. 2 illustrates an example of a four-cycle type full-color image forming apparatus in which image formation of a non-magnetic single-component development system is feasible.

Image forming sections are arranged vertically in a line. Intermediate transfer material unit 7 of an endless belt form is disposed on the left side of photoreceptors 1Y, 1M, 1C and 1K, as indicated in FIG. 2. Intermediate transfer material unit 7 comprises the intermediate transfer unit (7) of an endless belt form which can be turned via rollers 71, 72, 73, 74 and 76, primary transfer rollers 5Y, 5M, 5C and 5K and cleaning means 6A.

The image forming sections 10Y, 10M, 10C and 10K and the intermediate transfer unit 7 are pulled out of the body A by pulling the housing 8.

In the process of image formation, toner images are formed on photoreceptors 1Y, 1M, 1C and 1K, through electrostatic-charging, exposure and development, toner images of the individual colors are superimposed on the endless belt form, intermediate transfer material (70), transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Next, there will be described an image forming method using the toner of the invention as a nonmagnetic single-component developer. FIG. 2 illustrates an example of a full-color image forming apparatus using a nonmagnetic single-component developer. An image forming apparatus 100 shown in FIG. 2 is a typical image forming apparatus which can be installed with the developing device. In the image forming apparatus of FIG. 2, there are provided, around a rotary-drivable electrostatic latent image bearing body 1 (hereinafter, also denoted as a photoreceptor drum 1), an electrostatic-charging brush 2 to allow the surface of the photoreceptor drum 1 to be uniformly charged to a prescribed potential and a cleaner 6 to remove any residual toner on the photoreceptor drum 1.

A laser scanning optical system 3 scanning-exposes the surface of the photoreceptor drum 1 uniformly charged by the charging brush 2 to form a latent image on the photoreceptor drum. A laser scanning optical system 3 incorporates a laser diode, a polygon mirror and an fθ optical system, with the control section of which print data for each of yellow, magenta, cyan and black are transferred from a host computer. Based on the print data for the respective colors, laser beams are successively outputted to scan the surface of the photoreceptor drum 1 to form an electrostatic latent image of each color.

A development device unit 40, housing a development device 4, supplies the individual color toners to the photoreceptor drum 1 to perform development. The development device unit 40 is provided with four development devices 4Y, 4M, 4C and 4Bk which house nonmagnetic single-component toners of yellow, magenta, cyan and black, respectively, and rotate centering around a shaft 33 to guide the individual development device 4 to the position opposing the photoreceptor drum 1.

The development device unit 40 rotates centering around the shaft 33 every time an individual electrostatic latent image is formed on the photoreceptor drum 1 by the laser scanning optical system 3, and guiding the development device housing a corresponding color toner to the position opposing the photoreceptor drum 1. Then, the respective charged color toners are successively supplied from each of the development devices 4Y, 4M, 4C and 4Bk to perform development.

In the image forming apparatus of FIG. 2, an endless intermediate transfer belt 7 is provided on the downstream side in the rotation direction of the photoreceptor drum 1 from the development device unit 40 and is rotated in synchronization with the photoreceptor drum 1. The intermediate transfer belt 7 is in contact with the photoreceptor drum 1 with being pressed by a primary transfer roller 5 to transfer the toner image formed on the photoreceptor drum 1. A secondary rotating transfer roller 73 is provided opposite a support roller 72 to support the intermediate transfer belt 7 and a toner image carried on the intermediate transfer belt 7 is transferred onto a recording material P such as recording paper by being pressed at the site opposing the secondary transfer roller 73.

Between the full-color developing device unit 40 and the intermediate transfer belt 7, a cleaner 8 to remove any residual toner remained on the intermediate transfer belt 7 is provided with being detachable from the intermediate transfer belt 7.

A paper feeding means 60 for guiding the recording material (P) to the intermediate transfer belt 7 is constituted of a paper-feeding tray 61 housing recording material P, a paper-feeding 62 to feed the recording material P housed in the paper-feeding tray 61, sheet-by-sheet and a timing roller 63 to transfer the fed recording material P to the secondary transfer site.

The recording material P onto which a toner image has been transferred by being pressed is conveyed to a fixing device 24 through a conveyance means 66 constituted of an air-suction belt or the like, after which the transferred toner image is fixed on the recording material P in the fixing device 24. After fixing, the recording material P is conveyed through vertical conveyance route 80 and discharged onto the upper surface of apparatus body 100.

The image forming apparatus of FIG. 2 performs image formation with loading an exchangeable development device 4. A development device 4 shown in FIG. 3*a*, which is usually also called a toner cartridge, contains a prescribed amount of a toner within it where parts such as a developing roller are disposed. A development device, supplied in a cartridge form is mounted at a prescribed position within the image forming apparatus and supplies the contained developer to the photoreceptor drum to perform development. When no more developer remains after performing image formation of prescribed sheets, the cartridge is detached from the device and a new cartridge is loaded.

Figure 3:
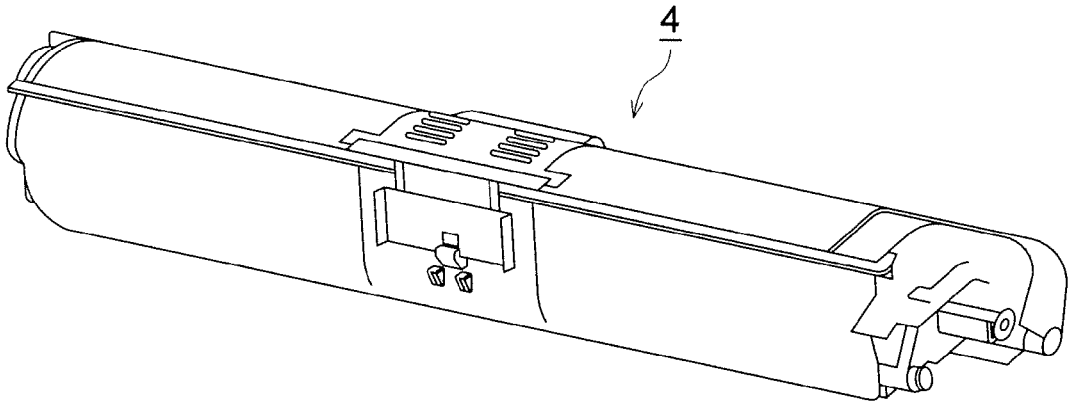
FIGS. 3(*a*) and 3(*b*) illustrate development devices (toner cartridge).
Figure 3:
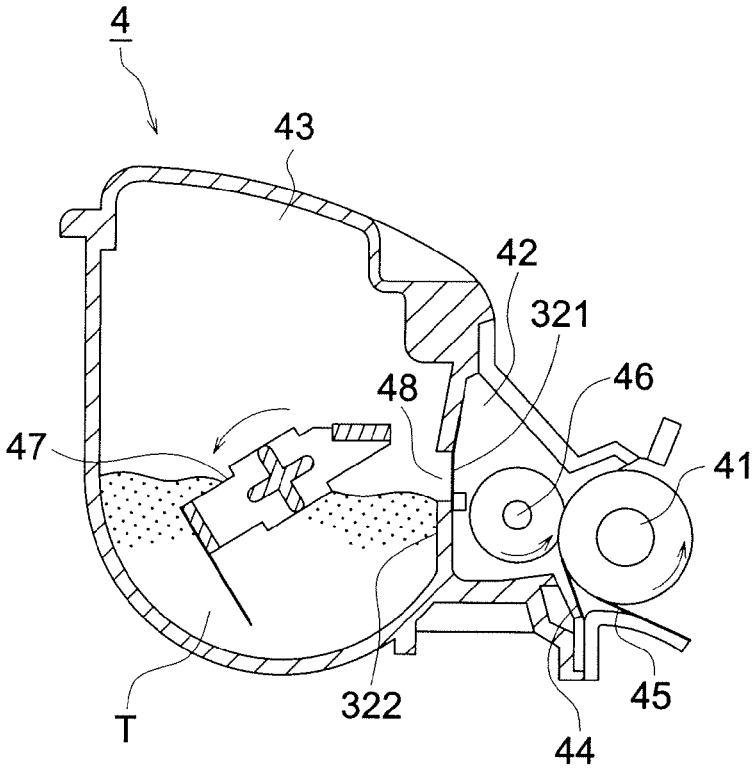

FIG. 3*b* illustrates a sectional view of the development device 4. Hereinafter, the development device 4 is also denoted as a toner cartridge 4. The toner cartridge 4 is provided with a buffer chamber 42 adjacent to a development roller 41 and a hopper 43 adjacent to the buffer chamber 42.

The development roller 41 is comprised of a conductive cylindrical substrate and an elastic layer formed of a hard material such as silicone rubber on the periphery of the substrate.

In the buffer chamber 42 is disposed a blade 44 as a toner controlling member with being pressed to the development roller 41. The blade 44 controls the electrostatic charge and the amount of toner applied onto the development roller 41. An auxiliary blade 45 to control the electrostatic charge and the amount of toner applied onto the development roller 41 may be provided downstream of the blade 41 with respect to the rotation of the development roller 41.

The development roller 41 is pressed against a feed roller 46. The feed roller 46 is rotated by a motor in the same direction as the development roller 41 (counterclockwise). The feed roller 46 is provided with an electrically conductive cylindrical substrate and a foamed layer formed of a urethane foam or the like on the periphery of the substrate.

A hopper 43 houses a toner T as a single-component developer. The hopper 43 is provided with a rotor 47 to stirring the toner. The rotor 47 is provided with a film-form conveyance blade to convey toner by rotation of the rotor 47 in the arrowed direction. The toner fed by the conveyance blade is fed into the buffer chamber 42 through passage 44 provided in the wall separating the hopper 43 from the buffer chamber 42. The shape of the conveyance blade is formed so that the blade bends while conveying the toner at the front in the rotation direction of the blade and returned to the straight state when reaching the left-side end of the passage 48. Thus, the blade feeds the toner to the pass 48 by allowing its shape to be returned straight via the bent state.

There is provided a valve 321 in the passage 48 to close the passage 48. The valve is a film-form member and one end of the valve is fixed at the upper right-hand side of the pass 48 and when the toner is fed from the hopper 43 to the pass 48, the valve is pressed to the right side by the pressure of the toner to open the passage 48. As a result, the toner is fed into the buffer chamber 42.

Further, a control member 322 is provided at the other end of the valve 321. The feed roller 46 is disposed so that the valve 321 forms a slight opening even when the passage 48 is closed. The control member 322 can be adjusted so that toner is not excessively accumulated at the bottom of the buffer chamber 42. It is so controlled that a toner which is recovered to the feed roller 46 from the development roller 41 does not fall in a large amount to the bottom.

In the toner cartridge 4, the development roller 41 rotates in the arrowed direction during image formation, while toner in the buffer chamber 42 is fed onto the development roller 41 through rotation of the feed roller 46. The toner fed onto the development roller 41 is electrically charged and thin-layered by the blade 44 and the auxiliary blade 45 and is then conveyed to the region opposed to the image bearing body, whereby the latent image on the image bearing body is subjected to development. A toner unused in development is returned to the buffer chamber 42 through rotation of the development roller 41 and is scraped off from the development roller 41 to recover the toner.

The toner of the invention causes no variation in crystal structure of a colorant contained in the toner at a heating temperature at the time of fixing in the prior art and stably color-reproducible toner images can be obtained in a conventional fixing device. Recently, there has been a trend of reduced energy consumption of an image forming apparatus in concern of the global environment. Specifically, a designed reduction of energy consumption in the fixing stage has been noted and there have been introduced techniques of fixing a toner images at a lower temperature than conventionally, corresponding to so-called low-temperature fixing.

When employing the toner of the invention as a toner corresponding to low-temperature fixing, the surface temperature of a heating member in a fixing device is preferably controlled to less than 140° C., and more preferably to less than 130° C.

Under the above temperature, it is required to achieve an efficient supply of heat from the heating member to a transfer sheet, so that fixing by using a heat-resistant belt in either a heating member or a pressing member, so-called belt-fixing is preferred.

Example

The embodiments of the invention will be described with reference to examples but the invention is by no means limited to these.

1. Preparation of Toners 1-18

1-1. Preparation of Toner 1 (Kneading/Grinding Method)

The toner constitution described below was placed in a HENSCHEL MIXER (produced Mitsui-Miike Kogyo Co., Ltd.) and mixed with stirring at a blade-circumferential speed of 25 m/sec for 5 min.

| | |
|---|---|
| Polyester resin (condensation product of bisphenol A/ethylene oxide adduct, terephthalic acid and trimeritic acid having a weight average molecular weight of 20,000) | 100 mass parts |
| Compound I-3 | 1.4 mass parts |
| Compound II-2 | 0.3 mass parts |
| Compound II-56 | 0.3 mass parts |
| Pentaerythritol tetrastearate | 6 mass parts |
| Boron dibenzylic acid (charge controlling agent) | 1 mass part |

The mixture was kneaded by a biaxial extrusion kneader, roughly ground by a hammer mill, further ground by a turbo-mill (produced by TURBO KOGYO Co., Ltd.) and was subjected to a fine powder classification treatment by an air classifier employing Coanda effect to obtain colored particles having a volume-based median diameter of 5.5 μm.

Next, to the foregoing colored particles were added external additives described below and subjected to an external treatment in a HENSCHEL MIXER to obtain Toner 1.

| | |
|---|---|
| Hexamethylsilane-treated silica (average primary particle size of 12 nm) | 0.6 mass parts |
| n-Octylsilane-treated titanium oxide (average primary particle size of 24 nm) | 0.8 mass parts |

The external treatment in HENSCHEL MIXER was conducted under conditions of a stirring blade circumferential speed of 35 m/sec, a treatment temperature of 35° C. and a treatment time of 15 min.

1-2. Preparation of Toners 2-28 (Developers 2-28)

Toners were prepared according to the emulsion coagulation method.

(1) Preparation of Particular Compound Dispersion 1:

11.5 parts by mass of sodium n-dodecylsulfate was placed in 160 parts by mass of deionized water and dissolved with stirring to prepare an aqueous surfactant solution. To the aqueous surfactant solution was added the following composition:

| | |
|---|---|
| Compound I-3 | 1.7 mass parts |
| Compound II-2 | 0.2 mass parts |
| Compound II-56 | 0.1 mass parts |

The foregoing composition was slowly added and dispersed by using CLEARMIX W-motion CLM-0.8 (produced by M Technique Co.) to obtain particular compound microparticle dispersion 1 [in which formula (I):formula (II)=85:15].

Compound microparticle 1 contained in the compound microparticle dispersion 1 exhibited a volume-based median diameter of 98 nm. The volume-based median diameter was measured by using MICROTRAC UPA-150 (produced by HONEYWELL Corp.) under the following condition:

| | |
|---|---|
| Sample refraction index: | 1.59 |
| Sample specific gravity: | 1.05 (equivalent converted to spherical particle) |
| Solvent refraction index: | 1.33 |
| Solvent viscosity: | 0.797 (30° C.), 1.002 (20° C.) |
| Zero-point adjustment: | adjustment by adding deionized water to a measurement cell. |

Particular compound dispersions 2-7 were prepared similarly to the foregoing particular compound dispersion 1, provided that amounts of the compounds I-3, II-2 and II-56 were varied as below:

| | |
|---|---|
| Particular compound dispersion 2 | |
| Compound I-3 | 1.4 mass parts |
| Compound II-2 | 0.3 mass parts |
| Compound II-56 | 0.3 mass parts |
| Particular compound dispersion 3 | |
| Compound I-3 | 1.2 mass parts |
| Compound II-2 | 0.6 mass parts |
| Compound III-56 | 0.2 mass parts |
| Particular compound dispersion 4 | |
| Compound I-3 | 1.5 mass parts |
| Compound II-2 | 0.5 mass parts |
| Particular compound dispersion 5 | |
| Compound I-3 | 1.0 mass parts |
| Compound II-2 | 0.7 mass parts |
| Compound II-56 | 0.3 mass parts |
| Particular compound dispersion 6 | |
| Compound I-3 | 1.8 mass parts |
| Compound II-2 | 0.1 mass parts |
| Compound II-56 | 0.1 mass parts |
| Particular compound dispersion 7 | |
| Compound I-3 | 0.8 mass parts |
| Compound II-2 | 0.6 mass parts |
| Compound II-56 | 0.6 mass parts |

The volume-based median diameter of the individual compound particles constituting each of the particulate compound dispersions 2-7 was 98 nm similarly to the particulate compound dispersion 1.

Particular compound dispersions 8-24 were prepared similarly to the foregoing particular compound dispersion 1, provided that a compound of formula (I) and a compound of formula (II) were each varied as below:

| | |
|---|---|
| Particular compound dispersion 8 | |
| Compound I-2 | 1.4 mass parts |
| Compound II-25 | 0.3 mass parts |
| Compound II-55 | 0.3 mass parts |
| Particular compound dispersion 9 | |
| Compound I-6 | 1.7 mass parts |
| Compound II-26 | 0.3 mass parts |
| Particular compound dispersion 10 | |
| Compound I-23 | 1.4 mass parts |
| Compound II-16 | 0.6 mass parts |
| Particular compound dispersion 11 | |
| Compound I-27 | 1.7 mass parts |
| Compound II-18 | 0.3 mass parts |
| Particular compound dispersion 12 | |
| Compound I-18 | 1.7 mass parts |
| Compound II-19 | 0.2 mass parts |
| Compound II-51 | 0.1 mass parts |
| Particular compound dispersion 13 | |
| Compound I-22 | 1.7 mass parts |
| Compound II-21 | 0.3 mass parts |
| Particular compound dispersion 14 | |
| Compound I-1 | 1.7 mass parts |
| Compound II-3 | 0.2 mass parts |
| Compound II-54 | 0.1 mass parts |
| Particular compound dispersion 15 | |
| Compound I-14 | 1.2 mass parts |
| Compound II-11 | 0.8 mass parts |
| Particular compound dispersion 15 | |
| Compound I-14 | 1.2 mass parts |
| Compound II-11 | 0.8 mass parts |
| Particular compound dispersion 16 | |
| Compound I-13 | 1.7 mass parts |
| Compound II-9 | 0.3 mass parts |
| Particular compound dispersion 17 | |
| Compound I-16 | 1.7 mass parts |
| Compound II-14 | 0.3 mass parts |
| Particular compound dispersion 18 | |
| Compound I-28 | 1.7 mass parts |
| Compound II-13 | 0.3 mass parts |
| Particular compound dispersion 19 | |
| Compound I-29 | 1.7 mass parts |
| Compound II-15 | 0.3 mass parts |
| Particular compound dispersion 20 | |
| Compound I-30 | 1.2 mass parts |
| Compound II-30 | 0.5 mass parts |
| Compound II-53 | 0.3 mass parts |
| Particular compound dispersion 21 | |
| Compound I-8 | 1.2 mass parts |
| Compound II-4 | 0.8 mass parts |
| Particular compound dispersion 22 | |
| Compound I-38 | 1.7 mass parts |
| Compound II-37 | 0.3 mass parts |
| Particular compound dispersion 23 | |
| Compound I-43 | 1.7 mass parts |
| Compound II-40 | 0.3 mass parts |

-continued

| | |
|---|---|
| Particular compound dispersion 24 | |
| Compound I-34 | 1.7 mass parts |
| Compound II-33 | 0.3 mass parts |

Particular compound dispersion 25 was prepared similarly to the foregoing particular compound dispersion 1, provided that compounds I-3, II-2 and II-56 were replaced by compounds in which silicon atoms (Si) in compounds I-3, II-2 and II-56 were respectively replaced by copper atoms (Cu).

Particular compound dispersions 26 and 27 were prepared similarly to the foregoing particular compound dispersion 1, provided that compounds I-3, II-2 and II-56 were replaced by compounds in which silicon atoms (Si) in compounds I-3, II-2 and II-56 were respectively replaced by titanium atoms (Cu) or zinc atoms (Zn).

(2) Preparation of Core Resin Particle 1:

Core resin particle 1 having a multilayer structure was prepared by the process of 1st polymerization, 2nd polymerization and 3rd polymerization steps.

(a) 1st Polymerization:

Into a reaction vessel fitted with a stirrer, a temperature sensor, a condenser and a nitrogen gas-introducing device was added 4 parts by mass of anionic surfactant (formula 1) together with 3040 parts by mass of deionized water to prepare an aqueous surfactant solution.

$C_{10}H_{21}(OCH_2CH_2)_2SO_3Na$ Formula 1:

To the foregoing aqueous surfactant solution was added a polymerization initiator solution of 10 parts by weight of potassium persulfate (KPS) dissolved in 400 parts by weight of deionized water and after the temperature was raised to 75° C., a mixed monomer solution comprised of the following compounds was dropwise added to the reaction vessel in 1 hr.

| | |
|---|---|
| Styrene | 532 mass parts |
| n-Butyl acrylate | 200 mass parts |
| Methacrylic acid | 68 mass parts |
| n-Octylmercaptan | 16.4 mass parts |

After completing addition of the foregoing monomer solution, the reaction mixture was heated with stirring at 75° C. for 2 hrs. to undergo polymerization (1st polymerization) to obtain resin particles. The obtained resin particles were designated as particulate resin A1. The weight-average molecular weight of the particulate resin A1 was 16,500.

(b) 2nd Polymerization:

To a flask fitted with a stirrer was added a mixed monomer solution of compounds describe below and subsequently, 93.8 parts by weight of paraffin wax HNP-57 (produced Nippon Seiro Co., Ltd.) as a releasing agent was added and dissolved with heating at 90° C. to prepare a monomer solution.

| | |
|---|---|
| Styrene | 101.1 mass parts |
| n-Butyl acrylate | 62.1 mass parts |
| Methacrylic acid | 12.3 mass parts |
| n-Octylmercaptan | 1.75 mass parts |

An aqueous surfactant solution was prepared by dissolving 3 parts by mass of the foregoing anionic surfactant in 1560 parts by mass of deionized water and heated at 98° C. To this aqueous surfactant solution was added the foregoing particulate resin A1 in an amount of 32.8 parts by mass (equivalent converted to solids), and the paraffin wax-containing monomer solution described above was added and was dispersed for 8 hrs. using a mechanical stirrer having a circulation pass, CLEARMIX (produced by M Technique Co.). There was thus prepared an emulsified particle dispersion comprised of emulsion particles having a dispersion particle size of 340 nm.

Subsequently, to the foregoing emulsified particle dispersion was added a polymerization initiator solution of 6 parts by mass of potassium persulfate dissolved in 200 parts by mass of deionized water. This reaction mixture was heated at 98° C. for 12 hrs. to undergo polymerization (2nd polymerization) to prepare resin particles. The thus prepared resin particles were designated as particulate resin A2. The weight-average molecular weight of the particulate resin A2 was 23,000.

(c) 3rd Polymerization:

To the particulate resin A2 obtained in the 2nd polymerization step was added a polymerization initiator solution of 5.45 parts by mass of potassium persulfate dissolved in 220 parts by mass of deionized water and a mixed monomer solution composed of the following compounds was dropwise added to the reaction vessel at 80° C. in 1 hr.

| | |
|---|---|
| Styrene | 293.8 mass parts |
| n-Butyl acrylate | 154.1 mass parts |
| n-Octylmercaptan | 7.08 mass parts |

After completing addition, the reaction mixture was heated with stirring for 2 hrs. to undergo polymerization (3rd polymerization). After completing polymerization, the reaction mixture was cooled to 28° C. to obtain core resin particle 1. The weight-average molecular weight of the core resin particle 1 was 26,800.

(3) Preparation of Shell Resin Particle:

Shell resin particle 1 was prepared similarly to the foregoing core resin particle 1, provided that the composition of the monomer solution used in the 1st polymerization step was changed as below.

| | |
|---|---|
| Styrene | 624 mass parts |
| 2-Ethylhexyl acrylate | 120 mass parts |
| Methacrylic acid | 56 mass parts |
| n-Octylmercaptan | 16.4 mass parts |

(4) Preparation of Toner 2

Toner 2 was prepared according to the procedure below.

(a) Formation of Core:

Into a reaction vessel fitted with a stirrer, a temperature sensor, a condenser and a nitrogen gas introducing device was placed the following composition:

| | |
|---|---|
| Core resin particle | 420.7 mass parts (equivalent converted to solid) |
| Deionized water | 900 mass parts |
| Colorant particle dispersion 1 | 200 mass parts |

The interior of the reaction vessel was adjusted to 30° C. and the pH was adjusted to 8-11 with an aqueous 5 mol/L sodium hydroxide solution.

Subsequently, further thereto, an aqueous solution of 2 parts by mass of magnesium chloride hexahydrate dissolved in 1000 parts by weight of deionized water was added at 30° C. for 10 min. After allowed to stand for 3 min., the mixture was heated to 65° C. in 60 min. to perform coagulation. Using MULTISIZER 3 (Coulter Co.), the dispersion was measured as such with respect to coagulated particle size and when coagulated particles reached a volume-based median diameter of 5.5 μm, there was added an aqueous solution of 40.2 parts by mass of sodium chloride dissolved in 1000 parts by mass of deionized water to terminate coagulation.

After terminating coagulation, ripening was conducted at 70° C. for 1 hr. to allow fusion to continue, whereby core 1 was prepared. The average circularity of the core 1, which was measured by FPIA 2000 (produced by SYSTEX Co. Ltd.), was 0.912.

(b) Formation of Shell:

Next, to the foregoing solution maintained at 65° C. was added 96 parts by mass of shell resin particle 1. Further thereto, an aqueous solution of 2 parts by mass of magnesium chloride hexahydrate dissolved in 1000 parts by mass of deionized water was added in 10 min. and the reaction mixture was heated to 70° C. and stirred for 1 hr. Thus, the shell resin particle 1 was melted onto the surface of the core 1 and ripening was carried out for 20 min to form a shell.

Thereafter was added an aqueous solution of 40.2 parts by mass of sodium chloride dissolved in 1000 parts by mass to terminate shell formation. The reaction mixture was cooled to 30° C. at a cooling rate of 8° C./min. The colored particles thus formed were filtered off and repeatedly washed with deionized water of 45° C., and dried with hot air of 40° C. to prepare colored particle 2 having a shell on the core surface.

(c) External Additive Treatment:

The colored particle 2 was added with the following external additives and subjected to an external treatment with stirring in a HENSCHEL MIXER to prepare toner 2.

| | |
|---|---|
| Hexamethylsilane-treated silica (average primary particle size of 12 nm) | 0.6 mass parts |
| n-Octylsilane-treated titanium oxide (average primary particle size of 24 nm) | 0.8 mass parts |

The external treatment in a Henschel mixer was conducted under conditions of a stirring blade circumferential speed of 35 m/sec, a treatment temperature of 35° C. and a treatment time of 15 min.

(5) Preparation of Toners 3-28

Toners 3-28 were prepared similarly to the foregoing toner 2, provided that the particulate compound dispersion 1 was replaced by either one of particulate compound dispersions 2-27.

(6) Preparation of Developers 1-28

Each of the foregoing toners 1-28 was mixed with ferrite carriers covered with silicone resin, having a volume average particle size of 60 μm to prepare developers 1-28, each having a toner concentration of 6%. Toners constituting developers 1-25 fall within the constitution of the invention, while a toner constituting developers 26-28 do not fall within the constitution of the invention.

Toners 1-28 (Developers 1-28) prepared according to the foregoing procedure are shown in Table 7.

TABLE 7

| | Toner (Developer) | | | | | |
|---|---|---|---|---|---|---|
| | | | Composition | | | |
| | Preparation | | Disper- | | | |
| | No. | Method | sion | Compound (mass %) | | |
| Example 1 | 1 | *1 | — | I-3(70) | II-2(15) | II-56(15) |
| Example 2 | 2 | *2 | 1 | I-3(85) | II-2(10) | II-56(5) |
| Example 3 | 3 | *2 | 2 | I-3(70) | II-2(15) | II-56(15) |
| Example 4 | 4 | *2 | 3 | I-3(60) | II-2(30) | II-56(10) |
| Example 5 | 5 | *2 | 4 | I-4(75) | II-2(25) | — |
| Example 6 | 6 | *2 | 5 | I-3(50) | II-2(35) | II-56(15) |
| Example 7 | 9 | *2 | 8 | I-2(70) | II-25(15) | II-55(15) |
| Example 8 | 10 | *2 | 9 | I-6(85) | II-26(15) | — |
| Example 9 | 11 | *2 | 10 | I-23(70) | II-16(30) | — |
| Example 10 | 12 | *2 | 11 | I-27(85) | II-18(15) | — |
| Example 11 | 13 | *2 | 12 | I-18(85) | II-19(10) | II-51(5) |
| Example 12 | 14 | *2 | 13 | I-22(85) | II-21(15) | — |
| Example 13 | 15 | *2 | 14 | I-1(85) | II-3(10) | II-54(5) |
| Example 14 | 16 | *2 | 15 | I-14(60) | II-11(40) | — |
| Example 15 | 17 | *2 | 16 | I-13(85) | II-9(15) | — |
| Example 16 | 18 | *2 | 17 | I-16(85) | II-14(15) | — |
| Example 17 | 19 | *2 | 18 | I-28(85) | II-13(15) | — |
| Example 18 | 20 | *2 | 19 | I-29(85) | II-15(15) | — |
| Example 19 | 21 | *2 | 20 | I-30(60) | II-30(25) | II-53(15) |
| Example 20 | 22 | *2 | 21 | I-8(60) | II-4(40) | — |
| Example 21 | 23 | *2 | 22 | I-38(85) | II-37(15) | — |
| Example 22 | 24 | *2 | 23 | I-43(85) | II-40(15) | — |
| Example 23 | 25 | *2 | 24 | I-34(85) | II-33(15) | |
| Example 24 | 7 | *2 | 6 | I-3(90) | II-2(5) | II-56(5) |
| Example 25 | 8 | *2 | 7 | I-3(40) | II-2(30) | II-56(30) |
| Comparison 1 | 26 | *2 | 25 | | | |
| Comparison 2 | 27 | *2 | 26 | | | |
| Comparison 3 | 28 | *2 | 27 | | | |

*1: kneading/grinding method
*2: emulsion coagulation method

2. Evaluation

The foregoing developers were allowed to stand under high temperature and high humidity environment (30° C., 80% RH), or under low temperature and low humidity environment (10° C., 20% RH) over a prescribed period of time and influence of environment was evaluated with respect to electrostatic charge after being allowed to stand and color of printed images.

(1) Electrostatic-Charging Capability

Each of developers 1-28 was placed into a developing device used in commercially available printer, BIZHUB C352 (produced by Konica Minolta Business Technologies Inc.) to prepare a developing device having a cyan toner. Two developing devices were arranged for each of developers, loaded onto a single body driving machine to drive a cyan developing device of the printer and were allowed to stand for 48 hrs. at 20° C. and 50% RH. After being allowed to stand for 48 hrs., one of the two developing devices was allowed to stand for 72 hrs. at 30° C. and 80% RH and the other one was allowed to stand for 72 hrs. at 10° C. and 20% RH.

After being allowed to stand for 72 hrs., the printer was driven for 30 sec. and for 1200 sec., and immediately after elapse of the individual driving time, 5 g of the loaded developer was sampled. An electrostatic charge of the sampled developer was measured by a blow-off type electrostatic charge meter, TB-200 (produced by Toshiba Chemical Co., Ltd.) under the foregoing conditions. The difference (ΔQ) between an electrostatic charge after being driven for 30 sec. (Qa) and that after being driven for 1200 sec. (Qb) was determined and evaluated.

In both cases when allowed to stand under an environment at a temperature of 33° C. and a humidity of 80% RH, and when allowed to stand under an environment at 10° C. and 12% RH, a difference (ΔQ) between an electrostatic charge after being driven for 30 sec. (Qa) and that after being driven for 1200 sec. (Qb) being less than 5 μC/g was judged to be acceptable in practice. Specifically, in both cases, ΔQ being less than 3 μC/g was rated to be superior.

(2) Image Color

After driven for 1200 sec., a solid cyan image print, exhibiting a reflection density of 0.8, was prepared and color of the outputted solid image was evaluated by comparison with a color chart used for a Web, comprised of 136 color samples with color code and color name. Evaluation was made in such a manner that color of the outputted solid image was visually compared with color samples on the color chart from the Web to cite the color name and color code of a color sample which was judged to be the closest to color of the solid image. Specifically, evaluation was made based on the following criteria:

A: being closest to a color code of #00FFFF and the color name of cyan or aqua,

B: being closest to a color code of #87CEEB or #87CEFA and the color name of sky blue or light sky blue, C: being closest to a color code of #40E0D0 or #00BFFF and the color name of turquoise or deep sky blue, D: being close to a color code of #1E90FF and the color name of dodger blue if it had to be compared, or there was no correspondence.

Of the foregoing, A, B and C were rated to be acceptable in practice.

Representation of colors used in the foregoing visual color evaluation of color images is as follows. Thus, representation of colors used for color evaluation employs a color code expressed by a # symbol and a 6-digit alphanumeric character, and a color name expressed by a specific color name such as red, green or white, and these are control codes indicating a color represented on the Web.

As described above, the color code represents a color by a # (sharp) symbol, followed by 6-digit hexadecimal number. The 6-digit alphanumeric character expressed by a hexadecimal number in the color code means as follows. In a color code of #FFFFFF, for example, the first two digits after the # symbol represents red, the central two digits represent green and the final two digits represent blue, and representing these three primary colors of light in terms of a hexadecimal number of 00-FF. A hexadecimal number closer to 00 becomes a weaker color and when is closer to FF, the color is accentuated.

Specifically, designation "#FF0000", in which red is FF (maximum), and green and blue are 00 (minimum), represents a red color. Designation "#FFFFFF", in which all of red, green and blue are FF (maximum), represents white, while designation "#000000", in which all of red, green and blue are 00 (minimum), represents black. Thus, the above color code represents a color by combining three hexadecimal numbers of red, green and blue, enabling to primarily represent many colors. This color code is also called RGB code.

The color name represents the name of color in English and there exist color names of 147 colors. In accordance with World Wide Web Consortium [W3C; an international organization established in 1994, promoting standardization of techniques employed in the WWW (Internet), there are colors, called 16 standard colors of which the name can be directly specified through HTML. Colors defined as standard 16 colors include "Red", "Yellow", "Lime", "Aqua", "Blue", "Fuchsia", "Maroon", "Olive", "Green", "Teal", "Navy", "Purple", "Black", "Gray", "Silver" and "White".

Results are shown in Table 8

TABLE 8

| | Toner | Electrostatic Charge (μC/g) ΔQ = Qa − Qb | | | | | | Image Color | |
|---|---|---|---|---|---|---|---|---|---|
| | | 30° C., 80% RH | | | 10° C., 20% RH | | | 30° C. | 10° C. |
| | No. | Qa | Qb | ΔQ | Qa | Qb | ΔQ | 80% RH | 12% RH |
| Example 1 | 1 | 33.5 | 31.0 | 2.5 | 35.1 | 37.3 | 2.2 | A | A |
| Example 2 | 2 | 34.2 | 30.3 | 3.9 | 34.7 | 38.3 | 3.6 | B | B |
| Example 3 | 3 | 33.1 | 30.5 | 2.6 | 33.6 | 35.8 | 2.2 | A | A |
| Example 4 | 4 | 34.1 | 31.7 | 2.4 | 34.5 | 36.8 | 2.3 | A | A |
| Example 5 | 5 | 33.9 | 31.1 | 2.8 | 34.2 | 37.1 | 2.9 | A | A |
| Example 6 | 6 | 33.9 | 29.9 | 4.0 | 34.3 | 38.2 | 3.9 | B | B |
| Example 7 | 9 | 33.7 | 31.3 | 2.4 | 33.5 | 36.1 | 2.6 | A | A |
| Example 8 | 10 | 33.8 | 29.5 | 4.3 | 36.0 | 40.5 | 4.5 | C | B |
| Example 9 | 11 | 33.0 | 30.5 | 2.5 | 34.1 | 36.8 | 2.7 | A | A |
| Example 10 | 12 | 33.3 | 28.5 | 4.8 | 34.4 | 39.1 | 4.7 | B | C |
| Example 11 | 13 | 33.6 | 29.3 | 4.3 | 34.0 | 38.4 | 4.4 | B | B |
| Example 12 | 14 | 33.5 | 29.3 | 4.2 | 34.8 | 42.8 | 4.0 | B | C |
| Example 13 | 15 | 33.8 | 30.6 | 3.2 | 34.3 | 37.8 | 3.5 | A | B |
| Example 14 | 16 | 33.5 | 30.8 | 2.7 | 34.1 | 37.0 | 2.9 | A | A |
| Example 15 | 17 | 33.7 | 30.2 | 3.5 | 34.0 | 37.4 | 3.4 | B | A |
| Example 16 | 18 | 33.9 | 30.2 | 3.7 | 34.4 | 38.0 | 3.6 | A | B |
| Example 17 | 19 | 33.5 | 30.2 | 3.3 | 33.9 | 37.6 | 3.7 | A | B |
| Example 18 | 20 | 33.8 | 30.2 | 3.6 | 34.4 | 37.8 | 3.4 | B | A |
| Example 19 | 21 | 33.9 | 31.1 | 2.8 | 34.8 | 37.4 | 2.6 | A | A |
| Example 20 | 22 | 33.8 | 31.2 | 2.6 | 34.5 | 37.2 | 2.7 | A | A |
| Example 21 | 23 | 32.9 | 28.7 | 4.2 | 33.8 | 38.1 | 4.3 | B | C |
| Example 22 | 24 | 32.6 | 28.2 | 4.4 | 34.3 | 38.7 | 4.4 | B | C |
| Example 23 | 25 | 32.6 | 27.8 | 4.8 | 34.3 | 39.0 | 4.7 | B | C |
| Example 24 | 7 | 31.1 | 26.3 | 4.8 | 33.1 | 37.8 | 4.7 | C | C |
| Example 25 | 8 | 31.8 | 27.0 | 4.8 | 35.1 | 39.7 | 4.6 | C | C |
| Comparison 1 | 26 | 30.8 | 22.6 | 8.2 | 33.1 | 42.0 | 8.9 | D | D |
| Comparison 2 | 27 | 30.1 | 21.5 | 8.6 | 32.6 | 41.8 | 9.2 | D | D |
| Comparison 3 | 28 | 29.8 | 21.0 | 8.8 | 32.8 | 42.1 | 9.3 | D | D |

Qa: Electrostatic charge (μC/g) after being driven for 30 sec.

Qb: Electrostatic charge (μC/g) after being driven for 1200 sec.

As shown in Table 8, it was proved that Examples 1-25 using developers corresponding to toners relating to the invention exhibited excellent results, achieving advantageous effects of the invention. Thus, it was proved that even after being allowed to stand under an environment of high temperature and high humidity, or low temperature and low humidity, the developers containing the toners relating to the invention performed sufficient charging without being adversely affected by such an environment, enabling to obtain color images of excellent color. On the contrary, it was also proved that Comparisons 1-3 using developers corresponding to toners falling outside the scope of the invention did not attain effects achieved in Examples 1-25.

As can be seen from the foregoing results, it was proved that the toners relating to the invention exhibited stable electrostatic-charging capability and enabled to obtain excellent color images even after being allowed to stand under an environment such as high temperature and high humidity, or low temperature and low humidity.

What is claimed is:

1. A toner comprising a resin and a colorant, wherein the colorant comprises a compound represented by formula (I) and a compound represented by formula (II):

formula (I)

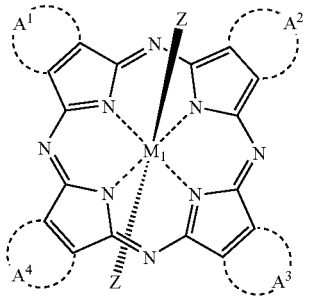

wherein $M_1$ is a metal atom selected from the group consisting of a silicon atom, a germanium atom and a tin atom; Z is a group represented by formula (III); and $A^1$, $A^2$, $A^3$ and $A^4$ are each independently an atomic group necessary to form a ring and selected from the group consisting of (1) to (29) which may be substituted by an electron-attractive group:

formula (II)

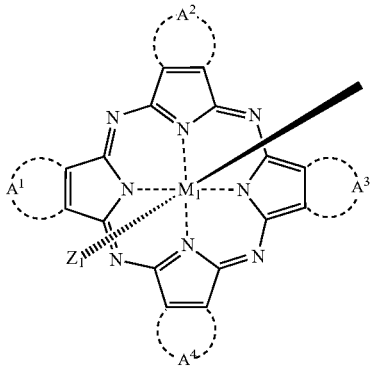

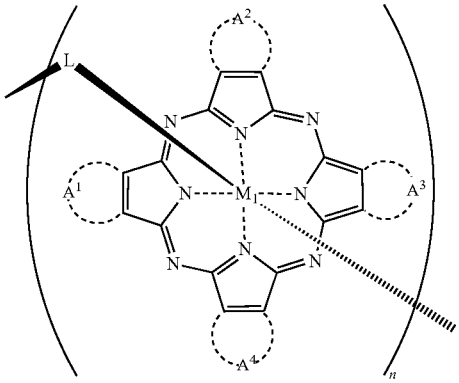

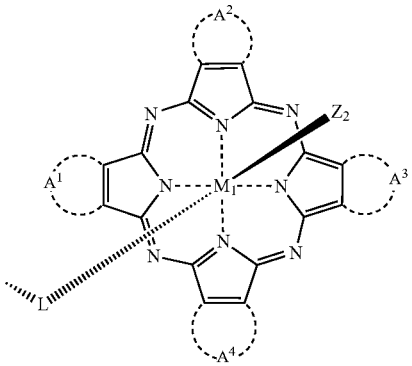

wherein n is 0 or an integer of 1 or more; $M_1$ is a metal atom selected from the group consisting of a silicon atom, a germanium atom and a tin atom; $Z_1$ and $Z_2$ are each a group represented by formula (III); L is an oxygen atom or —O—Si $(R)_2$—O— in which R is an alkyl group having 1 to 4 carbon atoms, a chlorine atom or a hydroxy group; $A^1$, $A^2$, $A^3$ and $A^4$ are each independently an atomic group necessary to form a ring and selected from the group consisting of (1) to (29) which may be substituted by an electron-attractive group;

formula (III)

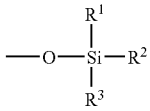

wherein $R^1$, $R^2$ and $R^3$ are each an alkyl group having 1 to 22 carbon atoms, an aryl group having 6 to 18 carbon atoms, an alkoxy group having 1 to 22 carbon atoms or an aryloxy group having 6 to 18 carbon atoms, provided that $R^1$, $R^2$ and $R^3$ may be the same or different;

(1)

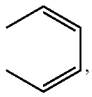

(2)

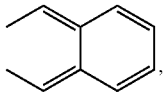

(3)

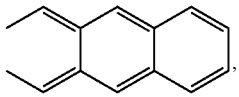

(4)

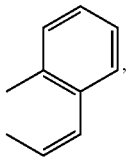

(5)

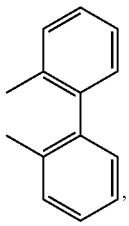

(6)

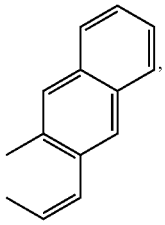

(7)

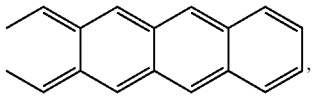

(8)

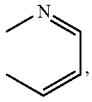

(9)

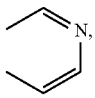

-continued (10)

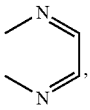

(11)

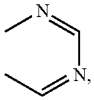

(12)

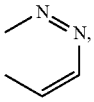

(13)

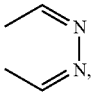

(14)

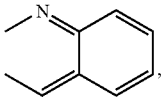

(15)

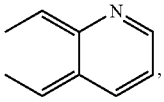

(16)

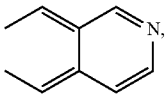

(17)

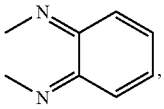

(18)

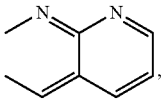

(19)

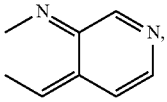

(20)

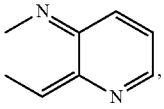

(21)

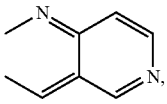

(22)

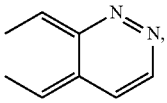

-continued (23)

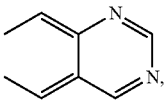

(24)

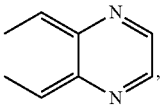

(25)

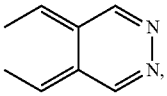

(26)

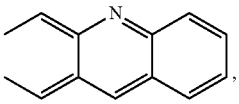

(27)

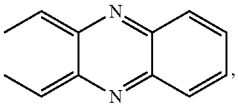

(28)

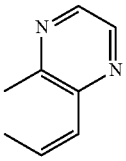

(29)

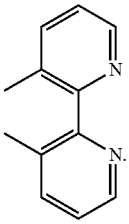

2. The toner of claim 1, wherein a ratio by mass of the compound represented by formula (I) to the compound represented by formula (II) is from 85:15 to 50:50.

3. The toner of claim 1, wherein a ratio by mass of the compound represented by formula (I) to the compound represented by formula (II) is from 75:25 to 60:40.

4. The toner of claim 1, wherein in formulas (I) and (II), $M_1$ is a silicon atom.

5. The toner of claim 1, wherein in formula (III) of formula (I) or formula (II), $R^1$, $R^2$ and $R^3$ are each a group selected from the group consisting of methyl, ethyl, n-propyl, isopropyl, n-butyl, isobutyl and t-butyl groups.

6. The toner of claim 1, wherein in formula (II), L is an oxygen atom.

7. The toner of claim 1, wherein in formulas (I) and (II), the ring formed of $A^1$, $A^2$, $A^3$ or $A^4$ is an aromatic ring.

8. The toner of claim 7, wherein the aromatic ring is a benzene ring or a naphthalene ring.

9. The toner of claim 7, wherein the aromatic ring is a benzene ring.

* * * * *